United States Patent [19]

Clark

[11] Patent Number: 4,459,084

[45] Date of Patent: Jul. 10, 1984

[54] INTERNAL COMBUSTION DRIVEN PUMPING SYSTEM AND VARIABLE TORQUE TRANSMISSION

[76] Inventor: Garry E. Clark, 4605 Elmhurst Dr., Douglasville, Ga. 30135

[21] Appl. No.: 266,933

[22] Filed: May 26, 1981

[51] Int. Cl.[3] ..... F04B 17/00

[52] U.S. Cl. ..... 417/11; 417/364

[58] Field of Search ..... 417/11, 340, 364, 380

[56] References Cited

U.S. PATENT DOCUMENTS

| | | | |
|---|---|---|---|
| 1,083,568 | 1/1914 | Ungar . | |
| 2,334,688 | 11/1943 | Norton . | |
| 2,352,267 | 6/1944 | Kelsey . | |
| 3,157,996 | 11/1964 | Budzich . | |
| 3,606,591 | 9/1971 | Potma | 417/364 |
| 3,751,905 | 8/1973 | McKinley et al. | 417/340 X |
| 3,922,854 | 12/1975 | Coeurderoy | 60/413 |
| 3,986,796 | 10/1976 | Molroux et al. | 417/364 |
| 3,990,235 | 11/1976 | Bauchet | 60/413 |
| 3,995,974 | 12/1976 | Herron | 417/380 X |
| 4,115,037 | 9/1978 | Butler | 417/364 X |
| 4,205,638 | 6/1980 | Vlacancinch | 417/380 X |

OTHER PUBLICATIONS

Lestz, Melton & Rambie, "Feasibility of Cooling Diesel Engines by Introducing Water, etc.", Paper No. 750129, Soc. Auto. Eng. 1975.

Stang, "Insulated Pistons Raise Diesel Efficiency," Automotive Engineering, vol. 86, No. 6, Jun. 1978, pp. 72–76.

Ferris, "Toward a Hydraulic Prime Mover," Paper No. 780748, Soc. of Auto. Engineers 1978.

*Primary Examiner*—Leonard E. Smith

*Attorney, Agent, or Firm*—Jones & Askew

[57] ABSTRACT

An internal combustion driven fluid pumping apparatus for accumulating fluid pressure to be applied against a load includes a two-stroke combustion cylinder having a piston drivingly connected to a piston of a linearly disposed compression cylinder, which is in turn connected by a fluid conduit to a pressure accumulator. The accumulator is operatively connected to the compression cylinder such that the frequency of cycles of the combustion cylinder varies with the changes in the demand of the load upon the fluid pressure stored in the accumulator, and such that the speed of the pistons in each individual stroke is substantially constant. To begin each cycle, fluid is forced into the compression cylinder at a pressure less than the pressure of fluid in the accumulator, but sufficient to compress and ignite combustible gases in the combustion cylinder. A transmission system is also provided wherein a variable volume hydraulic pump including a pump shaft drivingly connected to the load is driven by the shaft of a hydraulic motor, which is in turn driven by a high pressure fluid source. Fluid conduits connect the low pressure output of the motor to the low pressure input of the pump, and the high pressure output of the pump to the high pressure input of the motor, or to an accumulator. The displacement of the pump can be varied to vary the torque transmitted to the load, while maintaining the torque of the motor at a substantially constant rate.

35 Claims, 10 Drawing Figures

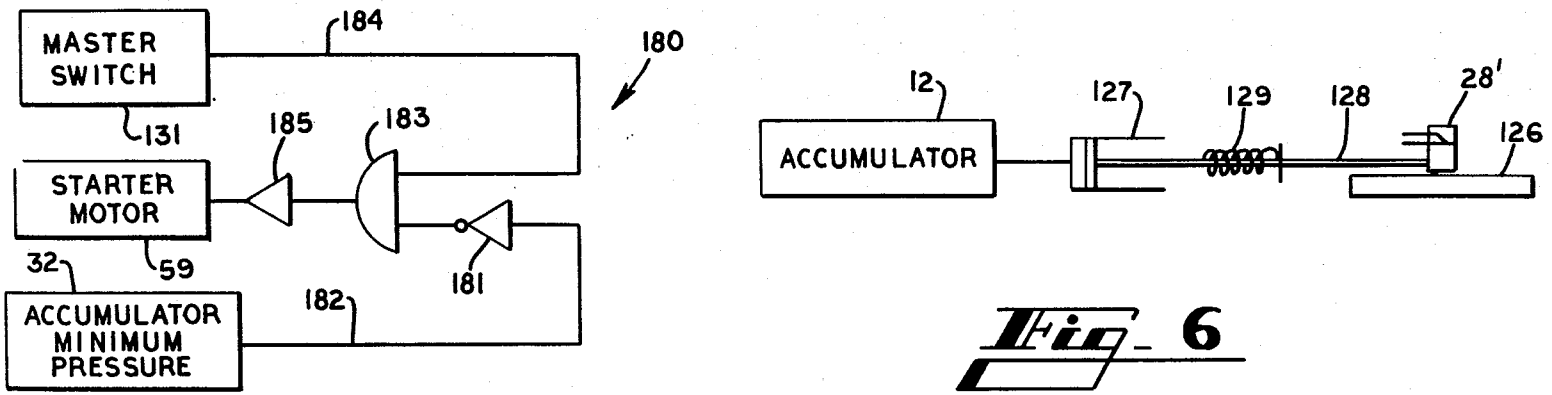
Fig. 6
Fig. 4
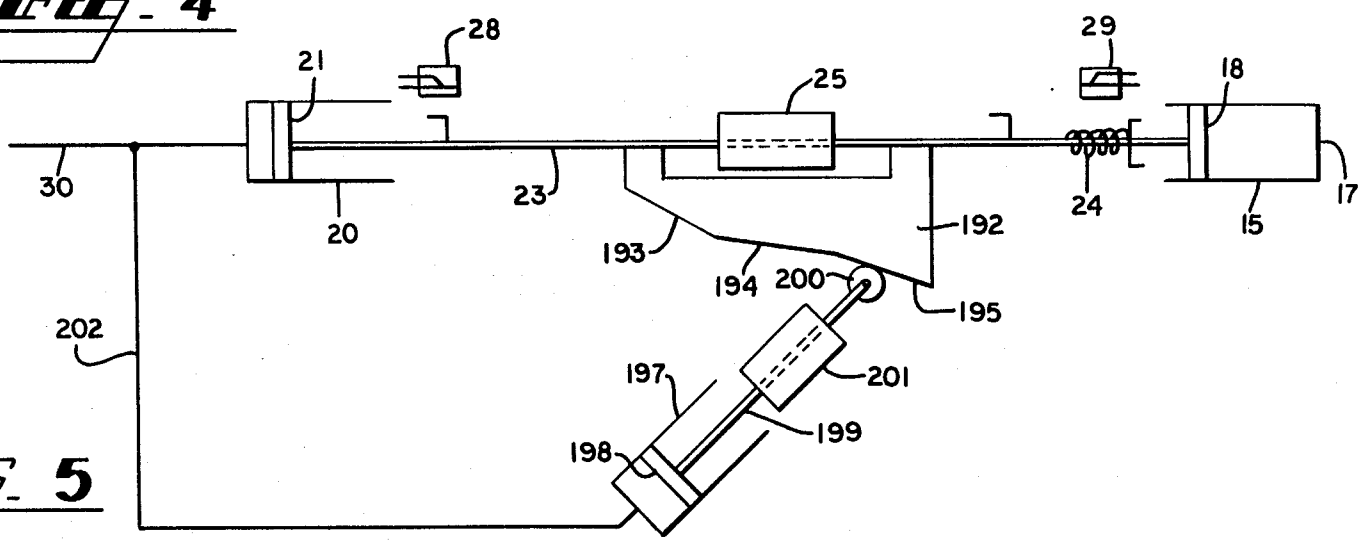
Fig. 5

INTERNAL COMBUSTION DRIVEN PUMPING SYSTEM AND VARIABLE TORQUE TRANSMISSION

TECHNICAL FIELD

The present invention relates to internal combustion power sources, and relates more particularly to an internal combustion engine and a fluid pump driven thereby for storing energy in an accumulator, and to a power transmission system for efficiently transmitting energy from the accumulator to a load.

BACKGROUND ART

Present rotational internal combustion engines, such as diesel engines, are known to be relatively inefficient. At full load, the maximum efficiency of converting the heat of combustion into brake work is only about thirty-six percent, and this efficiency drops as the load and RPM change from optimum conditions. The losses which occur in rotational engines are attributable in part to the rotational manner of operation of such engines. Since the angle between the piston connecting rod and a radius to the center of the crankshaft is constantly changing, the proportion of the combustion pressure applied directly to the load also varies. In addition, such engines experience further losses during idling when the demand of the load is stopped at intermittent intervals. Multiple cylinders are provided for smoothness of operation, and this gives rise to a larger cylinder wall area through which heat is lost to the cooling water which must circulate around the exterior of the cylinders. The multiplicity of cylinders also increases friction losses. Furthermore, a large amount of heat energy is exhausted into the atmosphere.

Internal combustion engines have been used to operate hydraulic pumping systems. For example, in U.S. Pat. No. 1,083,568, a rotational internal combustion engine is used to drive a hydraulic pump. A starting mechanism is provided to start the rotational engine in response to a drop in the hydraulic pressure stored in the system. U.S. Pat. No. 2,334,688 discloses an internal combustion pump having a mechanically linked combustion piston and compression piston. U.S. Pat. No. 3,986,796 discloses an integral piston which functions as a compression piston, combustion piston and a bounce piston. U.S. Pat. No. 4,115,037 discloses a 2-cycle, internal combustion engine driving a hydraulic pump, there being a mechanical linkage between a combustion piston head and a compression piston head. U.S. Pat. No. 3,751,905 discloses a steam generating apparatus including dual pistons which are moved in the compression stroke toward a central combustion zone by fluid pressure from an accumulator, U.S. Pat. No. 2,352,267 discloses the injection of water into a combustion cylinder during combustion.

It has also been recognized that fixed displacement hydraulic motors are efficient means for transferring energy into rotational form. However, attempts to vary the torque applied to a load by such a hydraulic motor have generally taken the form of reducing the pressure of fluid supplied to the motor by using flow dividing valves, throttling valves and the like. Such devices result in the dissipation of energy and a reduction in efficiency.

Energy storage in hydraulic pumping and motor systems is known. In U.S. Pat. No. 3,922,854, a drive motor drives a primary fluid pump, and also drives an auxiliary pump which can be used to accumulate fluid pressure during times of low demand for later direct application to the load. U.S. Pat. No. 3,157,996 and U.S. Pat. No. 3,990,235 each disclose systems in which a drive engine drives a pump which drives hydraulic motors to turn a load, and in which an accumulator is provided in the fluid conduit between the pump and the motor.

SUMMARY OF THE INVENTION

The present invention provides an improved internal combustion driven fluid pumping system in which accumulated pressure built up by the system is utilized to operate the compression stroke of an internal combustion cylinder, responsive to the accumulated pressure falling below a set level. Output of the pumping system is determined by the frequency of firing of the two-cycle combustion cylinder, and is responsive to the demand of a load upon the accumulated pressure, with the speed of operation of the combustion cylinder piston remaining substantially constant at its most efficient level. The accumulated fluid pressure is connected to an improved power transmission system in which a fixed displacement hydraulic motor is mechanically connected to a variable displacement hydraulic pump, which is in turn mechanically connected to a load.

Generally described, the internal combustion driven fluid pumping system comprises a combustion cylinder including a first reciprocable piston therein, means for admitting combustible gases into the combustion cylinder, a compression cylinder including a second reciprocable piston therein drivingly linked to the first piston, an accumulator containing fluid and connected by a fluid path to the compression cylinder, means for sensing the pressure of fluid in the accumulator, control means responsive to a drop in the pressure of fluid in the accumulator below a predetermined level for forcing fluid into the compression cylinder to move the second piston from a starting position and thereby to move the first piston within the combustion cylinder to compress and ignite the combustible gases therein, and a check valve in the fluid path between the accumulator and the compression cylinder for preventing escape of pressurized fluid from the accumulator, whereby fluid at high pressure is pumped into the accumulator from the compression cylinder.

The control means can utilize fluid pressure from the accumulator to force fluid into the compression cylinder, and advantageously can force such fluid into the fluid path between the check valve and the compression cylinder at a pressure below that of the fluid in the accumulator. Sensors can be provided to monitor the position of the linked combustion and compression pistons, and further control means can be provided to relieve the pressure in the compression cylinder if combustion does not occur within a normal period of time. This is made necessary, for example, by a misfire, in which case the pressure relief prepares the system for the next stroke. A mass can be mounted for travel with the first and second pistons, the mass being sufficient to smooth the motion of the pistons following combustion in the combustion cylinder. The fluid pressure in the accumulator can also be utilized to operate control valves related to the operation of the compression cylinder, the relief system and various air, fuel and water inputs to the combustion cylinder, as described in detail below.

The internal combustion system according to the invention is also made more efficient by the injection of water into the combustion cylinder immediately following consumption of fuel therein, in order to cool the combustion cylinder and provide expanding steam to increase the pressure in the combustion cylinder. Further efficiency is realized by placing insulation on the exterior of the combustion cylinder and by providing a heat exchanger between the air input line to the combustion cylinder and the exhaust pipe.

The present invention also provides a hydraulic transmission system comprising a variable volume hydraulic pump including a pump shaft drivingly connected to a load, a hydraulic motor including a motor shaft drivingly connected on the pump shaft, a first fluid conduit connecting a source of fluid pressure to a high pressure inlet of the motor, a second fluid conduit connecting a low pressure outlet of the motor to a low pressure inlet of the pump, and means for varying the output of the pump while maintaining the torque of the motor at a substantially constant rate, whereby the torque transmitted to the load through the pump shaft is controlled by controlling the output of the pump. It will thus be seen that the torque applied to the load can be varied without dissipating energy as would occur in reducing the pressure of fluid applied to the motor. The energy not required to apply torque to the load is recycled or stored by operation of the pump returning fluid which has passed through the motor to the high pressure fluid source or to the motor inlet. The pump can also be utilized as a hydraulic motor to supplement the motoring power of the transmission system. The motor and pump system according to the invention can also be used to effectively brake the load.

Thus, it is an object of the present invention to provide an improved internal combustion driven fluid pumping system.

It is a further object of the present invention to provide a two-stroke internal combustion engine which operates at a constant efficient speed during each stroke, the output of the engine being determined by the dwell time between strokes which is responsive to the demand upon the system.

It is a further object of the present invention to provide an internal combustion driven fluid pumping system in which the compression stroke is operated by fluid pressure accumulated by the pumping system, responsive to the accumulated pressure dropping below a set level.

It is a further object of the present invention to provide the advantages of an internal combustion driven pumping system according to the invention in embodiments having either a constant length combustion stroke or a variable length combustion engine.

It is a further object of the present invention to provide an improved hydraulic transmission system for transmitting power from a fluid pressure source to a load.

It is a further object of the present invention to provide an improved hydraulic transmission system which utilizes a hydraulic pump to vary the torque applied to a load by a hydraulic motor.

Other objects, features and advantages of the present invention will become apparent upon consideration of the following detailed description of the invention when taken in conjunction with the drawing and the appended claims.

BRIEF DESCRIPTION OF THE DRAWING

FIG. 4 is a schematic control circuit diagram for a starting system for the internal combustion driven pumping system of FIGS. 1 and 2.

FIG. 5 is a schematic hydraulic circuit diagram showing a second embodiment of an internal combustion driven pumping system according to the invention.

FIG. 6 is a schematic diagram showing a variable position detector for use with a system embodying the invention.

DETAILED DESCRIPTION

Figure 1:
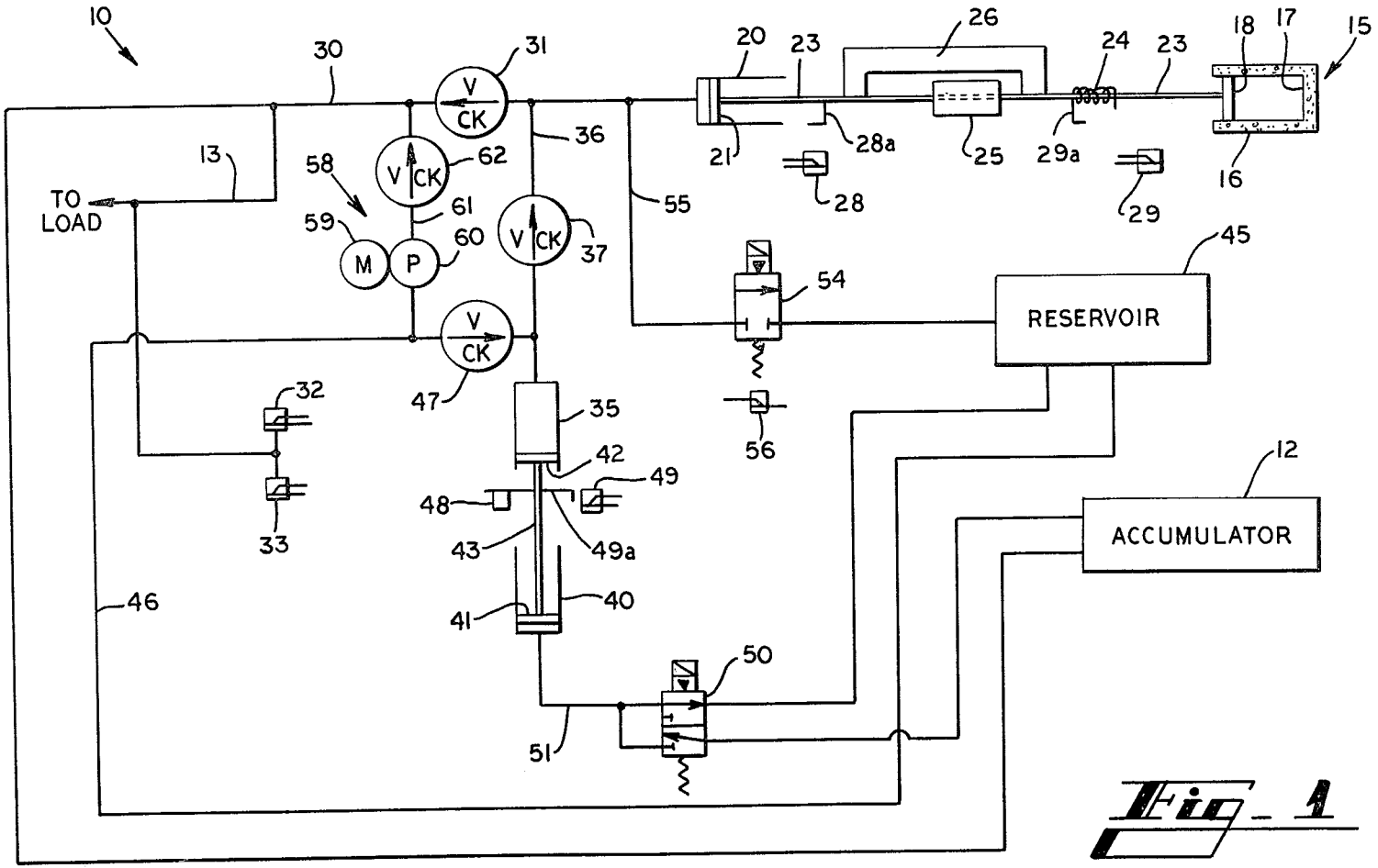
FIG. 1 is a schematic hydraulic circuit diagram showing an embodiment of the internal combustion driven pumping system according to the present invention.

Referring now to more detail to the drawing, in which like reference numerals refer to like parts throughout the several views, FIG. 1 shows a schematic hydraulic circuit diagram of an internal combustion driven fluid pumping apparatus 10 embodying the present invention. The apparatus 10 includes an accumulator 12 for storing the energy of fluid compressed by the apparatus. Fluid under pressure may be withdrawn from the accumulator 12 and applied to a load through a high pressure conduit 13, via a valving or transmission system (not shown) in FIG. 1. The apparatus 10 also includes a combustion cylinder 15 surrounded by a layer of insulation 16. The insulation 16 can be any suitable known insulating material capable of sustaining the heat generated by combustion of liquid fuel in the combustion cylinder 15. The combustion cylinder 15 includes a head 17 which defines a plurality of openings for intake and exhaust functions shown in FIG. 2, and described in detail below. A combustion cylinder piston 18 is mounted within the cylinder 15 for reciprocating movement in a conventional manner.

A compression cylinder 20, comprising a conventional hydraulic cylinder, is disposed in linear relationship with the combustion cylinder 15. A compression cylinder piston 21 is mounted for reciprocating movement within the compression cylinder 20, and is directly connected to the combustion cylinder piston 18 by a connecting rod 23. A return spring 24 urges the connecting rod 23, and therefore the compression piston 21 and the combustion piston 18, toward the compression cylinder 20, thereby tending to force fluid out of the compression cylinder 20 and draw the combustion piston 18 away from the cylinder head 17. Movement of the connecting rod 23 is confined and facilitated by a linear bearing 25, through which the connecting rod passes. A mass 26 is mounted for travel with the connecting rod 23. The mass is sufficiently massive to smooth the movement of the pistons and connecting rod following the impulse of force from combustion of fuel in the combustion cylinder 15.

For purposes of timing the operation of the elements of the apparatus 10, it is necessary to detect when the compression and combustion pistons 21 and 18 have completed the compression stroke, and when they have completed the power or return stroke. For this purpose, a position detector 28 is mounted adjacent to the connecting rod 23 so as to be activated by a trigger 28*a* when the compression cylinder piston 21 has completed its return stroke into the compression cylinder 20. Also, a position detector 29 is mounted adjacent to the connecting rod 23 so as to be activated by a trigger 29*a* when the combustion cylinder piston 18 has completed the compression stroke into the combustion cylinder 15. The position detectors 28 and 29 can be limit switches or inductance-type magnetic detectors.

The accumulator 12 is connected to the compression cylinder 20 by a fluid conduit 30. The fluid conduit 30 includes a check valve 31 which prevents high pressure fluid pumped into the accumulator by the compression cylinder 20 from returning past the check valve 31. The pressure in the accumulator 12 is monitored for the occurence of two critical pressures. An accumulator start pressure detector 32 provides a signal when the accumulator pressure is above the minimum value required to operate the compression cylinder 20 to sufficiently compress combustible gases in the combustion cylinder 15 to cause the gases to ignite. An accumulator low pressure detector 33 provides a signal when the pressure in the accumulator falls below a predetermined pressure, indicating that another stroke of the internal combustion driven pumping apparatus 10 is required. Those skilled in the art will understand that the functions of the pressure detectors 32 and 33 could be combined and the necessary signals provided in response to pressure measured by a single pressure transducer.

In the apparatus 10, the compression cylinder 20 is pressurized to drive the compression stroke by utilizing fluid pressure of the accumulator 12. To accomplish this, a fluid amplifier cylinder 35 is connected by a fluid conduit 36 to the fluid conduit 30 between the check valve 31 and the compression cylinder 20. The conduit 36 includes an amplifier output check valve 37 which prevents fluid from returning from the conduit 30 to the amplifier cylinder 35. A drive cylinder 40 is disposed in linear relation to the amplifier cylinder 35, and includes a drive cylinder piston 41. The amplifier cylinder 35 includes an amplifier cylinder piston 42 which is directly connected to the drive cylinder piston 41 by a connecting rod 43. Both the amplifier cylinder 35 and the drive cylinder 40 are conventional hydraulic cylinders, but the cross-sectional area of the amplifier cylinder piston 42 is greater than that of the drive cylinder piston 41. For example, the area of the drive cylinder piston can be about three square inches and the area of the amplifier cylinder piston about seven square inches. The area of the compression cylinder piston 21 preferably equals that of the amplifier cylinder piston 42, and the combustion cylinder piston 18 is larger than the other pistons, for example, about twenty square inches. If the accumulator pressure is, for example 1500–3000 psi, the intermediate pressure generated by the amplifier cylinder 35 would be about 700–1500 psi, and the pressure generated within the combustion cylinder would reach about 600 psi.

A reservoir 45 is connected to the fluid conduit 36 between the check valve 37 and the amplifier cylinder 35. The conduit 46 includes an amplifier input check valve 47 which prevents fluid being ejected from the amplifier cylinder 35 from travelling to the reservoir 45. The reservoir 45 is maintained at a pressure of about 25 psi.

The travel of the amplifier cylinder piston 42 out of the amplifier cylinder 35 is limited by a mechanical stop 48. When the piston 42 reaches the mechanical stop 48, a position detector 49 is triggered by a trigger 49*a*, and provides a signal indicating that the amplifier cylinder piston 42 is fully retracted.

Operation of the drive cylinder 40 is controlled by a drive cylinder control valve 50, which is connected to the drive cylinder 40 by a fluid conduit 51. The control valve 50 is an electrically operated solenoid valve which alternately connects the conduit 51 to the accumulator 12 or to the reservoir 45.

In order to permit pressure in the conduit 30 to be relieved, for example, when a misfire occurs in the combustion cylinder 15, a relief valve 54 is connected to the conduit 30 adjacent to the compression cylinder 20 by a fluid conduit 55. The relief valve 54 is an electrically operated solenoid valve which alternately closes the conduit 55 or connects it to the reservoir 45. A position detector 56 is positioned to provide an electrical signal when the relief valve 54 is closed.

A starter mechanism 58 is provided for those instances when the accumulator pressure falls below the pressure required to initiate combustion. The starter 58 includes a starter motor 59, which can be an electric motor. The motor 59 operates a hydraulic starter pump 60 which pumps fluid from the reservoir 45 along a fluid conduit 61 into the fluid conduit 30 between the accumulator 12 and the check valve 31. The conduit 61 includes a check valve 62 which prevents high pressure fluid from passing from the accumulator 12 to the pump 60.

Figure 2:
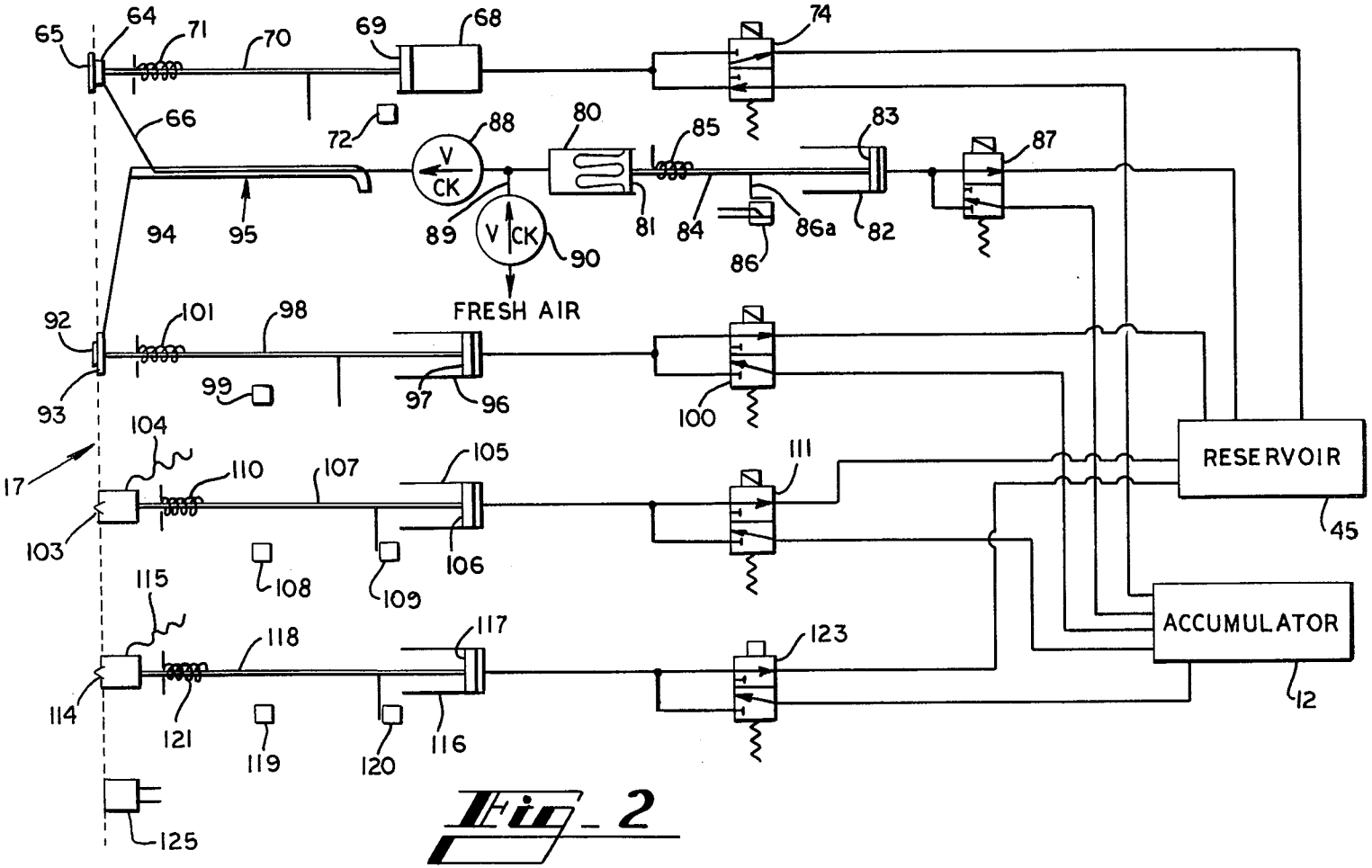
FIG. 2 is a schematic diagram showing inputs to the combustion cylinder head of the system shown in FIG. 1.

A plurality of intake and exhaust devices associated with the combustion cylinder head 17 are shown in FIG. 2. The surface of the combustion cylinder head 17 is represented diagramatically by a vertical dashed line. An intake valve 64 operates against an intake valve seat 65 and opens to the exterior of the combustion cylinder 15. Air is supplied into the cylinder 15 through an opening defined by the valve seat 65, from an air input pipe 66. An intake valve operating cylinder 68 includes a piston 69 which is connected to the intake valve 64 by a connecting rod 70, which is biased by an intake valve spring 71 away from the cylinder head 17. The connecting rod 70 passes through a sealed opening in a wall of the air input pipe 66 in a manner which is well known and therefore not shown. The stroke of the piston 69 from the intake valve operating cylinder 68 is limited by a mechanical stop 72. Operation of the intake valve operating cylinder 68 is determined by an intake valve cylinder control valve 74. The valve 74 is an electrically operated solenoid valve which alternately connects the operating cylinder 68 to the accumulator 12 or to the reservoir 45.

A pneumatic air input cylinder 80 is connected to the air input pipe 66 for forcing air through the intake valve 64. The cylinder 80 includes a piston 81. An air drive hydraulic cylinder 82 is disposed in linear relationship with the pneumatic cylinder 80, and includes a piston 83 that is directly connected to the piston 81 by a connecting rod 84. A return spring 85 biases the connecting rod 84 and connected pistons toward the hydraulic drive cylinder 82. Full retraction of the air input piston 81 out of the air input cylinder 80 is detected by an air drive position detector 86 which is activated by a trigger 86*a*. The air drive hydraulic cylinder 82 is operated by an air drive cylinder control valve 87, which is an electrically operated solenoid valve which alternately connects the cylinder 82 to the accumulator 12 or to the reservoir 45. An air delivery check valve 88 is provided in the air input pipe 66 to prevent air from returning to the air input cylinder 80. The air input cylinder 80 is refilled from atmosphere through an air conduit 89 that includes an input check valve 90.

An exhaust valve 92 opens inwardly into the cylinder head 17, passing through an opening defined by an exhaust valve seat 93. Exhaust is conducted through an exhaust pipe 94 to atmosphere. For a substantial portion of the length of the air input pipe 66, the exhaust pipe jackets the air input pipe and is connected thereto by metallic fins, to form a heat exchanger 95. The exhaust valve is opened and closed by an exhaust valve operating hydraulic cylinder 96, which includes a piston 97. The piston 97 is directly connected to the exhaust valve 92 by a connecting rod 98, and an exhaust valve return spring 101 biases the exhaust valve toward the operating cylinder 96, that is, into the closed position. A mechanical stop 99 limits the movement of the piston 97 toward the cylinder head 17. Operation of the exhaust valve opening cylinder 96 is controlled by an exhaust valve operating cylinder control valve 100, which is an electrically operated solenoid valve which alternately connects the exhaust valve operating cylinder 96 to either the accumulator 12 or the reservoir 45.

A fuel injector 103 of a type known to those skilled in the art is also associated with the cylinder head 17, and injects fuel supplied by a fuel line 104. The fuel injector is operated by a fuel injector drive cylinder 105 which includes a piston 106. The piston 106 is directly connected to the fuel injector 103 by a connecting rod 107, and the connecting rod 107 is biased toward the fuel injector cylinder 105 by a return spring 110. Travel of the connecting rod 107 and piston 106 toward the fuel injector 103 to activate the fuel injector is limited by a mechanical stop 108, and travel in the opposite direction into the fuel injector drive cylinder 105 is limited by a mechanical stop 109. The fuel injector drive cylinder 105 is operated by a fuel injector control valve 111, which is an electrically operated solenoid valve which connects the drive cylinder 105 to either the accumulator 12 or the reservoir 45.

Also associated with the cylinder head 17 is a water injector 114 which can be similar in construction to the fuel injector 103 and supplies water from a water line 115. The water injector 114 is operated by a water injector drive cylinder 116, which includes a piston 117. The piston 117 is directly connected to the water injector 114 by a connecting rod 118, and the connecting rod 118 is biased toward the drive cylinder 116 by a water injector return spring 121. Travel of the connecting rod 118 and the piston 117 toward the water injector to activate the water injector is limited by a mechanical stop 119, and travel in the opposite direction is limited by a mechanical stop 120. The water injector drive cylinder 116 is operated by a water injector control valve 123, which is an electrically operated solenoid valve which alternately connects the water injector cylinder 116 to either the accumulator 12 or the reservoir 45.

A heat sensor 125 of conventional construction is also mounted with respect to the cylinder head 17 to measure the temperature of the combustion cylinder 15.

FIG. 6 shows a modification of the apparatus 10 as shown in FIG. 1, necessary for operation in a variable stroke mode. FIG. 6 shows a position detector 28′ mounted in association with apparatus for adjusting the position of the detector 28′ so that the signal indicating that the compression cylinder piston 21 has completed the return stroke occurs at varying positions along the path of the connecting rod 23. The detector 28′ is slidably mounted along a linear track 126. A hydraulic drive cylinder 127 operates to change the position of the detector 28′ along the track 126, by means of a connecting rod 128 which connects the detector 28′ to the piston of the cylinder 127. The connecting rod and detector are biased toward the cylinder 127 by a return spring 129, and the cylinder 127 is connected to the accumulator 12. The strength of the return spring 129 is selected so that when the accumulator pressure is low, the spring 129 will shift the detector 28′ to the left along the track 126 as seen in FIG. 6. Correspondingly, if the accumulator pressure is high, the accumulator pressure will move the piston of the cylinder 127 and the detector 28′ against the pressure of the spring 129 so that the detector 28′ moves to the right along the track 126. Such variation in the position at which a ready signal is provided by the detector 28′ allows a shorter stroke to occur when the accumulator 12 is at a higher pressure, and a longer stroke to occur when the accumulator 12 is at a lower pressure.

Figure 3:
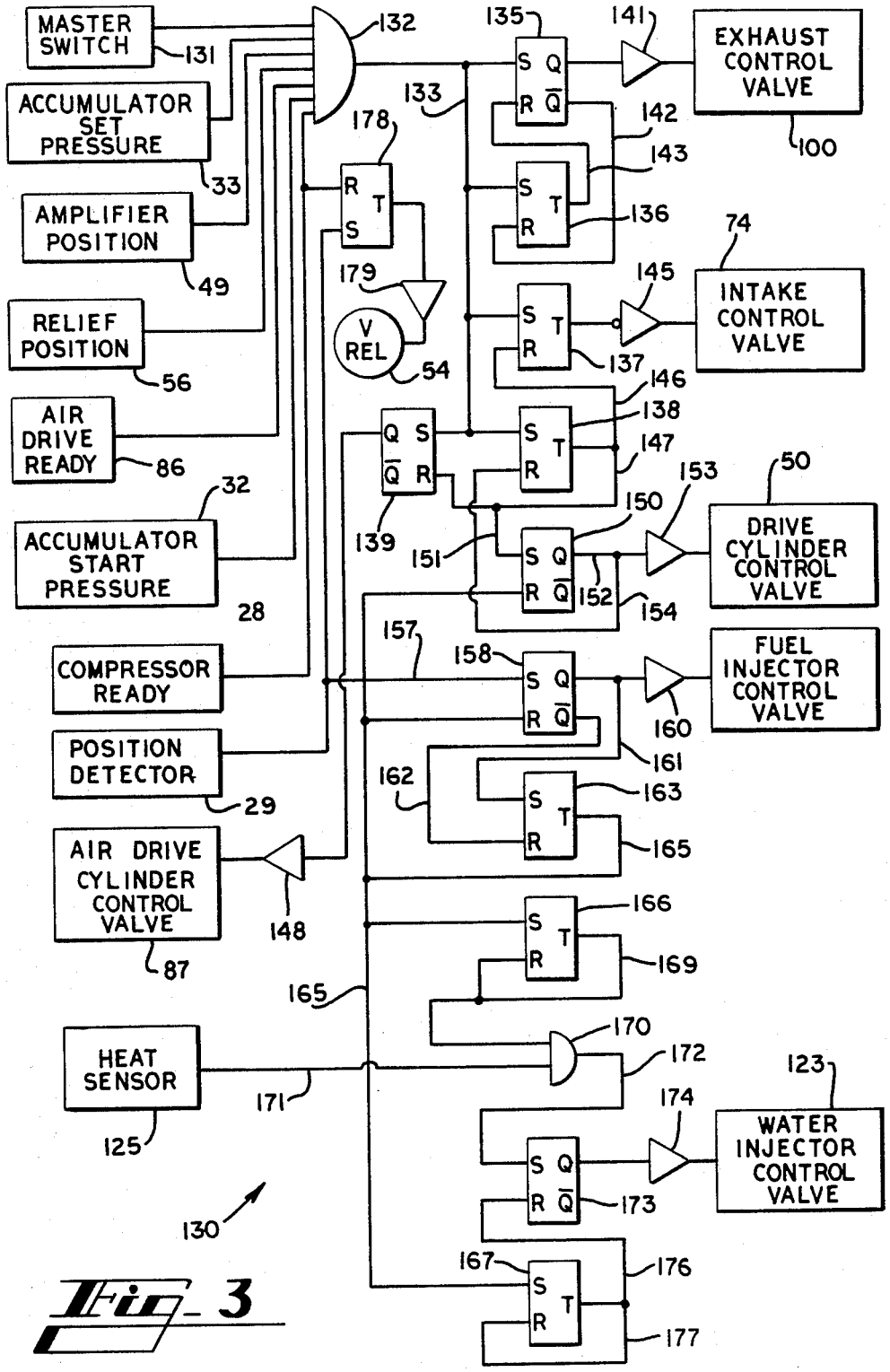
FIG. 3 is a schematic diagram of an electronic control circuit for operating the system shown in FIGS. 1 and 2.

An electronic control circuit for operating the internal combustion driven pumping apparatus 10 shown in FIGS. 1, 2 and 6 is shown diagrammatically in FIG. 3. In order for a cycle of the apparatus 10 to begin, a plurality of inputs must be present to an AND gate 132. A master switch 131 must be switched on, the accumulator start pressure detector 32 must be providing a signal indicating that the accumulator pressure is sufficiently high to operate the apparatus, the accumulator low pressure detector 33 must provide a signal indicating that the accumulator pressure is sufficiently low to require further input, the position indicator 28 must provide a signal indicating that the compression cylinder piston 21 has been fully returned to its starting position, the position indicator 49 must provide a signal indicating that the amplifier piston 42 has returned to rest against mechanical stop 48, the relief position detector 56 must provide a signal indicating that the relief valve 54 is in a closed position, and the position detector 86 must provide a signal indicating that the air input drive cylinder 82 is in its starting position, that is, connected to the reservoir 45 through the control valve 87.

When all such inputs to the AND gate 132 are present, a signal passes along an electrical line 133 to an exhaust flip/flop 135, an exhaust close delay timer 136, an intake opening delay timer 137, an intake closing delay timer 138, and an air drive flip/flop 139. The signal along line 133 sets the exhaust flip/flop 135 and the Q output is connected to a drive amplifier 141 which operates the exhaust valve control valve 100 to switch the valve 100 from reservoir to accumulator. The not Q output of the flip/flop 135 resets the exhaust close delay timer 136. The timer 136 is set by the signal along line 133, and when the time delay expires, the output of the timer 136 passes along line 143 to reset the exhaust flip/flop 135.

The signal along line 133 also starts the intake opening delay timer 137. An inverter 145 provides a signal to maintain the intake valve control solenoid valve 74 in a position connecting to the accumulator 12. The timer 137 is connected to the inverter 145, so that when the time delay expires, a signal is provided to the inverter and the intake valve solenoid 74 is switched to reservoir 45. The signal along line 133 also starts the intake closing delay timer 138. When the time delay expires, a signal is provided from timer 138 along the line 146 to reset the intake opening timer 137, and along line 147 to reset the air drive flip/flop 139. The air drive flip/flop is set by the signal along line 133, and the Q output of the flip/flop 139 is connected to an amplifier 148 which operates the air drive cylinder control valve 87 to switch the valve 87 from reservoir to accumulator.

A drive cylinder flip/flop 150 is set upon the expiration of the time delay of timer 138 by a signal along lines 147 and 151. The Q output of the flip/flop 150 is connected to an amplifier 153 which operates the drive cylinder control valve 50 to switch the valve 50 from reservoir to accumulator. The Q output of the flip/flop 150 also resets the intake closing delay timer 138.

The position detector 29 which indicates when the combustion cylinder piston 18 has completed the compression stroke, is connected along a line 157 to set a fuel flip/flop 158. The Q output of the flip/flop 158 is connected along line 159 to an amplifier 160 which operates the fuel injector control valve 111, switching the control valve 111 from reservoir to accumulator. The Q output of the flip/flop 158 is also connected along line 161 to start a fuel stop delay timer 163. The not Q output of the flip/flop 158 is connected along a line 162 to reset the fuel stop delay timer 163. When the time delay of the timer 163 expires, a signal is provided along line 165 to reset the drive cylinder flip/flop 150, reset the fuel flip/flop 158, start a water start delay timer 166, and start a water stop delay timer 167. When the time delay of the water start delay timer 166 expires, a signal is provided along a line 169 to reset the timer 166 and to provide one input to an AND gate 170. The second input to the AND gate 170 is provided along a line 171 from the heat sensor 125, indicating that the temperature of the combustion cylinder 15 is sufficiently high for water to be injected by the water injector 114. When both inputs to the AND gate 170 are present, a signal is provided along a line 172 to set a water injector flip/flop 173. The Q output of the flip/flop 173 is connected to an amplifier 174 that operates the water injector control valve 123 to switch the control valve 123 from reservoir to accumulator. The water stop delay timer is started concurrently with the water start delay timer 166, but has a longer time delay. When the time delay of the water stop delay timer 167 expires, a signal is provided along a line 176 to reset the water injector flip/flop 173, and also along a line 177 to reset the water stop delay timer 167.

The signal from the position detector 29 passing along line 157 is also connected to start a relief valve delay timer 178. When the time delay of the timer 178 expires, a signal is provided to an amplifier 179 which operates the relief valve 54 to switch the relief valve 54 from a closed position to a position open to the reservoir 45. However, the relief valve delay timer is connected to be reset by the signal from the position detector 28 indicating that the compression cylinder piston 21 has returned to its starting position. The time delay of the timer 178 is selected to be somewhat longer than the maximum expected time for the compression cylinder piston 21 to return to its starting position after normal combustion occurs in the combustion cylinder 15. Therefore, if a normal stroke occurs, the position detector 28 will reset the timer 178 before the time delay expires, and therefore the relief valve 54 will not be opened.

FIG. 4 shows a schematic representation of a starter control circuit 180 for initially starting the apparatus 10. An AND gate 183 receives inputs from the accumulator start pressure detector 32 along a line 182 as inverted by an inverter 181, and from the master switch 131 along a line 184. If the accumulator pressure measured by the detector 32 is less than the minimum pressure sufficient to operate the apparatus 10, then no signal will be present along line 182, and invertor 185 will provide one necessary input to AND gate 183. Thus, if the master switch is turned on, a signal will be provided from the AND gate 183 to an amplifier 181 which drives the starter motor 59, and therefore the starter pump 60, shown in FIG. 1.

In operation of the embodiment of the invention thus far described, the maaster switch 131 is turned on, and the control circuit 130 checks the necessary conditions for beginning the internal combustion cycle by means of the AND gate 132. If the fluid pressure in the accumulator 12 is not sufficiently high to operate the compression cylinder 20, then the starter motor 59 will be operated according to the circuit shown in FIG. 4, until a sufficient pressure level is reached in the accumulator. It is necessary to build up a gas pressure of about 600 psi in the combustion cylinder 15 during the compression cycle in order to ignite fuel injected therein.

When all of the other inputs described above are present, the control circuit operates the exhaust valve operating cylinder control valve 100. The exhaust valve operating cylinder 96 is thereby connected to the accumulator 12 and pressurized to move the piston 97 out of the operating cylinder 96 and to move the exhaust valve 92 away from the exhaust valve seat 93 against the pressure of the exhaust valve spring 101, until the mechanical stop 99 prevents further movement. This allows gases trapped inside the combustion cylinder to escape through the exhaust pipe 94. At the same time, the air drive cylinder control valve 87 is operated to connect the air drive cylinder 82 to the accumulator 12 whereby the cylinder 82 is pressurized, and the piston 83 is moved toward the air input cylinder. The piston 81 of the pneumatic air input cylinder 80 is connected by the connecting rod 84 to the piston 83, and therefore moves into the air input cylinder 80 against the pressure of the return spring 85. Air compressed by the air input cylinder 80 passes through the check valve 88 in the air input pipe 66, pressurizing the air in the air input pipe 66.

Shortly after the exhaust valve is opened and the air input cylinder begins to move, the intake opening delay timer 137 times out, and the signal going to the intake control valve 74 is removed. This causes the intake valve operating cylinder 68 to be connected to the reservoir 45, thereby allowing the return spring 71 to move the piston 69 into the operating cylinder 68, opening the intake valve 64. The valve 64 will open until movement is stopped by the mechanical stop 72. Since the intake valve opens to the outside of the cylinder head 17, an unobstructed entrance for the flow of air from the air input pipe 66 into the combustion cylinder 15 is created. Therefore, the compressed airstream enters the combustion cylinder 15 in a tightly compact stream which remains tightly compact until it reaches the combustion cylinder piston 18. When the air hits the combustion cylinder piston it spreads to fill the combustion cylinder 15 with fresh air starting at the piston end. This action drives the exhaust gases from the previous cycle out through the open exhaust valve 92. As the exhaust gases travel through the exhaust pipe 94 to atmosphere, the heat exchanger 95 transfers heat energy from the exhaust gases to the incoming air in the air input pipe 66. The heat exchanger 95 can be insulated to reduce heat loss to the surrounding atmosphere.

Moments after the intake valve opens and the exhaust gases have been expelled to the exhaust pipe, the exhaust valve close delay timer 136 times out, and transmits a signal to reset the exhaust flip/flop 135. This removes the operating signal from the exhaust control valve 100, so that the exhaust valve operating cylinder 96 is again connected to the reservoir, and the return spring 101 moves the piston 97 into the cylinder 96, closing the exhaust valve 92.

Directly after the closing of the exhaust valve, the intake close delay timer 138 times out, resetting the intake open delay timer 137 so that a signal is removed from the inverter 145, and a signal is thereby provided once again to the intake control valve 74. The switching of the valve 74 connects the intake valve operating cylinder 68 to the accumulator, pressurizing the cylinder 68 and moving the piston 69 out of the cylinder 68 to close the intake valve 64 against the intake valve seat 65, against the pressure of the return spring 71. The intake valve 64 will be held tightly against the seat 65 by the pressure in the cylinder 68 until the next cycle. The operating cylinder 68 exerts enough force against the intake valve to hold it tightly closed when the pressure within the combustion cylinder 15 is at its maximum during the power stroke.

The expiring of the time delay of the intake close delay timer 138 also resets the air drive flip/flop 139, thereby removing the operating signal from the air drive control valve 87. This connects the air drive cylinder 82 to the reservoir, causing the piston 83 to move back into the air drive cylinder 82 under pressure of the return spring 85. When the piston 83 has completed its inward stroke, the trigger **86*a* activates the position detector 86 to once again provide a signal indicating that the air drive cylinder is ready for the next cycle. The movement of the piston 83 also draws the piston 81 out of the air input cylinder 80. This draws fresh air into the air input cylinder 80 through the air line 89 and its check valve 90**.

The timing out of the intake close delay timer 138 also sets the drive cylinder flip/flop 150, thereby operating the drive cylinder control valve 50. This connects the drive cylinder 40 to the accumulator, and pressurizes the drive cylinder 40. The piston 41 then begins to move out of the drive cylinder 40, and thereby moves the fluid amplifier cylinder piston 42 into the fluid amplifier cylinder 35. The piston 42 has previously been moved to its starting position against the mechanical stop 48 by the pressure maintained in the reservoir 45.

The movement of the amplifier cylinder piston 42 ejects fluid into the line 36, past the amplifier output check valve 37, and into the fluid conduit 30, the relief valve 54 being closed. The fluid amplifier piston 42 preferably has a cross-sectional area that is greater than the cross-sectional area of the drive cylinder piston 41. Therefore, the pressure of fluid ejected by the amplifier piston 42 will be an intermediate pressure less than the pressure in the accumulator 12. Thus, fluid will flow into the compression cylinder 20, and the accumulator pressure will hold the check valve 31 closed. However, the specifications of the fluid amplifier cylinder 35 are also selected so that the pressure of its fluid output is suficient to cause combustion in the combustion cylinder 15 in a manner about to be described.

The fluid being driven from the amplifier cylinder 35 enters the compression cylinder 20, driving the compression cylinder piston 21 out of the compression cylinder 20. The movement of the piston 21 also moves the connecting rod 23 and the combustion cylinder piston 18, as well as the mass 26, against the force of the compression cylinder return spring 24. As the combustion cylinder piston 18 moves into the combustion cylinder 15, the fresh air delivered into the combustion cylinder 15 by the air input cylinder 80 through the intake valve 64 is compressed and thereby heated.

When the combustion piston 18 reaches the end of the compression stroke, the trigger **29*a* activates the position detector 29, which provides a signal along a line 157 of the control circuit to set the fuel inject flip/flop 158. The Q output of the flip/flop 158 is connected along a line 159 to an amplifier 160 which drives a fuel injector control valve 111. The activation of the fuel injector solenoid valve 111 switches the valve to connect the fuel injector drive cylinder 105 to the accumulator 12. This pressurizes the fuel injector drive cylinder 105, moving its piston 106 and connecting rod 107 against the pressure of return spring 110. The amount of fuel injected is controlled by the position of the full stroke mechanical stop 108. The movement of the connecting rod 107 activates the fuel injector 103 to spray fuel from the fuel line 104 into the combustion cylinder 15 through the head 17. The fuel ignites upon contact with the heated, compressed air in the combustion cylinder 15**, and the power stroke begins.

The Q output of the fuel inject flip/flop 158 has also started the fuel stop delay timer 163. The time delay of the timer 163 expires shortly after the fuel injector drive cylinder 106 reaches its full stroke mechanical stop 108, terminating injection of fuel. The timing out of the fuel stop delay timer 163 resets the drive cylinder flip/flop 150, removing the signal to the drive cylinder control valve 50 which switches back to its normal position connecting the drive cylinder 40 to the reservoir 45. This removes the force on the amplifier cylinder piston 35, and allows it to be moved by the pressure of the reservoir 45 back to its starting position mechanical stop 48. When this position is reached, the trigger **49*a* activates the amplifier cylinder ready position detector 49**.

The timing out of the fuel stop delay timer 163 also resets the fuel flip/flop 158, removing the signal from the fuel injector control valve 111. The fuel injector control valve 111 thereby switches back to connect the fuel injector drive cylinder 105 to the reservoir 45, and allow the fuel injector return spring 110 to return the fuel injector piston 106 to its starting position against mechanical stop 109. At this time fuel for the next stroke is drawn into the fuel injector 103.

The timing out of the fuel stop delay timer 163 also starts the water start delay timer 166 and the water stop delay timer 167. The time delay of the water start delay timer 166 is selected so that no water can be injected into the combustion cylinder 15 until combustion of the fuel is complete. The timing out of the water start delay timer 166 provides a signal along line 169 to reset the timer 166 and provide one input to the AND gate 170. The heat sensor 125 provides a signal as the other input to AND gate 170 if the temperature of the combustion cylinder 15 is above a minimum value which can be, for example, 250° F. The required minimum temperature prevents condensation of water in the cylinder 15. The operation of the heat sensor 125 to prevent water injection occurs primarily during start up of the apparatus 10 before normal operating temperature has been reached.

When both input signals are provided to the AND gate 170, a signal is provided along line 172 to set the water injector flip/flop 173. The Q output of the flip/-flop 173 is connected to an amplifier 174 that drives the water injector control valve 123. The water injector control valve 123 thereby is switched to connect the water injector drive cylinder 116 to the accumulator 12. This pressurizes the cylinder 116, and drives the water injector piston 117 out of the cylinder 116. The piston 117 is connected to the connecting rod 118 which is also moved to activate the water injector 114 against the pressure of the return spring 121, to inject water from the water line 115 into the combustion cylinder 15. The amount of water injected is controlled by the full stroke mechanical stop 119, which stops movement of the connecting rod 118 and the piston 117. The water injected into the combustion cylinder 15 mixes with the hot gases therein and turns into steam. This cools the combustion cylinder and increases the pressure within the combustion cylinder to allow more mechanical work to be extracted from the combustion process.

Shortly after water injection terminates, the time delay of the water injector stop delay timer 167 expires. Upon expiration, a signal is provided along the line 176 to reset the water injector flip/flop 173, removing the signal from the water injector control valve 123. This causes the control valve 123 to switch back to connect the water injector drive cylinder 116 to the reservoir 45. Thereupon, the water injector return spring 121 moves the connecting rod 118 and the piston 117 to their starting positions against the start mechanical stop 120, deactivating the water injector 114. At this time water is also drawn into the injector 114 from the water line 115 for the next stroke. The signal from the water stop delay timer 167 is also provided along line 177 to reset the timer 167.

The combustion of fuel and subsequent transformation of water into steam in the combustion cylinder 15 create a force that reverses the direction of the movement of the combustion and compression cylinder pistons 18 and 21. The return movement of the compression cylinder piston 21 compresses the fluid in the compression cylinder 20. However, the initial tendency of the explosive forces to move the pistons rapidly is resisted by the mass 26, which absorbs part of the initial combustion force to control the acceleration and maximum velocity of the power stroke. As the pressure on the combustion piston 18 decreases, the kinetic energy of the mass helps to keep the compression cylinder piston 21 moving to the end of the power stroke.

During the power stroke, the fluid pressure in the combustion cylinder rises until it is higher than the pressure in the accumulator 12. The compression cylinder output check valve 31 is forced open, and fluid flows from the compression cylinder into the accumulator 12, raising the pressure in the accumulator. In order to maximize efficient transfer of energy into the accumulator, to reduce stress on the system parts and allow the use of smaller components, the peak flow rate through the line 30 from the compression cylinder to the accumulator is preferably about 200–300 gallons per minute. Control of the peak flow rate can be maintained by adjusting the size of the mass 26 as well as the fuel, air and water parameters within the combustion cylinder 15. When the power stroke finishes, the trigger **28*a* will activate the compression cylinder ready position detector 28. At this point, if all of the necessary signals to the AND gate 132 are provided, the control circuit 130 will begin another cycle. If the demand on the accumulator 12 does not require further pressurization of the accumulator, the next cycle will be postponed until such a demand occurs. Thus, the internal combustion engine portion of the apparatus 10** does not idle and waste fuel as is the case is conventional rotational internal combustion engines.

If there is a misfire in the combustion cylinder 15, or, if for any other reason the compression cylinder piston 21 does not return to its starting position before the time delay of the relief valve timer 178 expires, then a signal will be provided to the amplifier 179 which drives the relief valve 54. The relief valve will switch to connect the fluid conduit 30 to the reservoir 45, thus relieving pressure which has built up in the conduit 30. Such a relief system is important because it returns the system to a ready state so that the next operation of the amplifier cylinder 35 will create proper pressure for a normal compression stroke. When the pressure in the conduit 30 is relieved, the compression cylinder return spring 24 will move the compression cylinder piston 21 into the compression cylinder 20 until the compression cylinder ready position detector 28 is triggered. The signal from the position detector 28 resets the relief valve delay timer 178, thereby removing the drive signal from the relief valve 54. The relief valve 54 then switches back to a closed position, and the system is ready for another cycle.

As described, the internal combustion driven fluid pumping apparatus 10 will operate in a constant accumulator pressure/constant stroke length/constant fuel mode. This assumes that the accumulator low pressure detector 33 is fixed at a constant setting, so that the apparatus 10 will cycle only when the load connected to the accumulator 12 reduces the pressure in the accumulator. The accumulator pressure therefore will be maintained at a constant value as determined by the detector 33. It will thus be seen that the accumulator pressure at the beginning of each cycle will be the same, and therefore, during a cycle the compression cylinder 20 will experience the same forces from the conduit 30. This results in a constant stroke length, and also in a constant fuel requirement.

Normally, in the constant accumulator pressure/constant stroke length mode, the frequency of cycling of the engine and thereby the dwell between cycles is controlled by the demand upon the fluid pressure in the accumulator 12. However, it is possible to control the cycling of the engine with an external timer (not shown) that could be independent of the accumulator pressure. To accomplish this, the input of the detector 33 to the AND gate 132 would be replaced with the timer output signal. When the predicted history of demand on the accumulator 12 is well known, then the use of a timer could advantageously smooth any jerkiness in the operation of the apparatus 10 in response to pressure.

In many applications, it may be desirable to alter the level of pressure at which the accumulator 12 is maintained. For example, if the apparatus 10 was used to power an automobile, the pressure of the accumulator 12 during cruising could be much less than the pressure required during initial acceleration. Obvious efficiencies can be realized by not continuously operating the internal combustion engine at a level which anticipates a maximum demand. In order to operate the apparatus 10 in a variable accumulator pressure/variable stroke length/constant fuel mode, the accumulator low pressure detector 33 is made adjustable, so that the pressure at which cycling of the apparatus is initiated can be varied. Also, the compression cylinder ready position detector 28 must be made adjustable. As the accumulator pressure varies, the force against which the compression cylinder piston 21 acts during the power stroke also varies, and therefore at constant fuel per stroke, the piston 21 will travel variable distances before equilibrium with the pressure in the accumulator 12 is reaches. The signal from the position detector 28 must be provided when the end of the power stroke is reached, regardless of where the compression cylinder piston 21 is at that time with respect to the compression cylinder 20.

An apparatus for automatically adjusting the point at which the compression cylinder ready signal is provided is shown in FIG. 6. The apparatus in FIG. 6 adjusts the physical position of the detector 28' with respect to the path of travel of the combustion cylinder piston 21 and the connecting rod 23. To accomplish this, the detector 28' is slidably mounted along a track 126 which is disposed parallel to the connecting rod 23 with the detector 28' still in the path of the trigger 28*a*. A detector adjustment drive cylinder 127 is disposed in linear relationship with the track 126, and includes a piston that is directly connected to the detector 28' by a connecting rod 128. A return spring 129 urges the piston into the drive cylinder 127. The cylinder 127 is connected by a fluid conduit to the accumulator 12. It will thus be seen that as the pressure in the accumulator 12 varies, the position of the piston within the cylinder 127 also varies. The strength of the return spring 129 is selected so that the piston, and therefore the detector 28', are moved to the left in FIG. 6 by the return spring 129 when the accumulator pressure is relatively low, and are moved to the right in FIG. 6 when the accumulator pressure is relatively high. This corresponds to the effect of the accumulator pressure on the length of the compression and power strokes, since the compression cylinder piston 21 will move further into the compression cylinder 20 (to the left in FIG. 1) when the accumulator pressure is low, but will not move as far into the compression cylinder 20 when the accumulator pressure is high. By making the position of the detector 28' directly responsive to the pressure in the accumulator 12, just as the stroke length is responsive to the accumulator pressure, proper choice of the drive cylinder 127 and the spring 129 will cause adjustment of the detector 28' automatically and in synchronization with the variation in the stroke length.

It should be noted that in the variable pressure/variable stroke length mode, the amount of air and fuel delivered to the combustion cylinder 15 need not be adjusted. When the stroke length is shorter, the air supplied to the combustion cylinder by the air input cylinder 80 is applied at a greater pressure because of the smaller volume between the combustion cylinder piston 18 and the cylinder head 17. This compensates for the fact that the combustion piston 18 moves a shorter distance, and therefore could not have compressed ambient temperature air to the desired high pressure for causing combustion of the injected fuel. The compression ratio remains constant even though the accumulator pressure varies.

The apparatus 10 can also be modified to operate in a variable accumulator pressure/constant stroke length/variable fuel mode. To accomplish this, automatic controls must be added to adjust the amount of air, fuel and water used for each pulse, and also to control the timing of the closing of the exhaust valve. Devices similar to that shown in FIG. 6 can be used to control the stroke length of the fuel injector drive cylinder 105 and the water injector drive cylinder 116 by adjusting the position of the full stroke mechanical stops 108 and 119, directly responsive to the accumulator pressure. An adjustable mechanical stop could similarly be provided to control the length of the stroke of the piston 81 into the air input cylinder 80. The fuel and water injectors also could be adjusted by making conventional metering devices responsive to a balanced cylinder and spring arrangement of the type shown in FIG. 6.

The foregoing modifications are necessary to obtain a constant stroke length when the accumulator pressure is varying, because the power required to move the compression cylinder piston the maximum distance when the accumulator pressure is at the highest point would require maximum amounts of air, fuel and water; when the accumulator pressure is at its lowest point, the minimum amount of air, fuel and water would be required to provide the same full stroke distance of the compression cylinder piston. In order to assure that the pressure in the combustion cylinder becomes sufficiently high to ignite the fuel, the exhaust valve close timing should also be controlled. The exhaust valve during the compression stroke would be held open for about one-half the distance of the compression stroke of the combustion cylinder piston when the pressure is lowest in the accumulator, and would be closed immediately when the accumulator pressure is the highest. When the accumulator pressure is low, this results in the exhaust gases being finally expelled by the movement of the combustion cylinder, whereas at high accumulator pressures, enough air is admitted into the combustion cylinder to force out all the previous exhaust. Also, at lower pressures, the combustion piston will be allowed to gather momentum before the exhaust valve closes, so that the lower accumulator pressure will be able to complete the compression stroke. It will be understood that the control of the timing of operation of the exhaust valve and the control over the amount and pressure of air input to the combustion cylinder have similar effects. Therefore, in some circumstances, it may be possible to utilize only one of these controls.

It should be noted that when the only capability desired is operation of the invention in a constant accumulator pressure/constant stroke length mode, the detailed controls shown in FIG. 2 for the fuel, air and water input devices associated with the cylinder head 17 can be replaced by more conventional valving arrangements operated by a cam shaft rotating in timed relationship according to the movement of the pistons 18 and 21 and the connecting rod 23. Also, the exhaust port could be located in the sidewall of the combustion cylinder 15 spaced away from the cylinder head 17, as is common in conventional two-stroke engines.

A second embodiment of the present invention is shown in FIG. 5, which is a schematic hydraulic circuit showing a portion of a pumping apparatus 190. The second embodiment 190 varies from the embodiment shown in FIGS. 1–4 in the manner in which the accumulator 12 is operatively interconnected with the compression cylinder 20 and the combustion cylinder 15. In other respects, the embodiment shown in FIG. 5 is identical to that previously described.

The apparatus 190 includes a cam 192 mounted for movement with the connecting rod 23. The cam 192 has a specifically selected profile including a starting slope 193 which extends relatively steeply away from the connecting rod 23, an intermediate slope 194 which extends less steeply away from the connecting 23, and a stopping slope 195 that again extends more steeply away from the connecting rod 23. The cam 192 replaces the mass 26 that was shown in FIG. 1. An auxiliary compression cylinder 197 is positioned adjacent to the cam 192, and includes a piston 198 which is connected to a connecting rod 199. The connecting rod 199 extends through a linear bearing 201 and terminates in a cam follower 200 which engages the profile of the cam 192. The auxiliary compression cylinder 197 is connected to the high pressure conduit 30 adjacent to the compression cylinder 20 by a fluid conduit 202.

In operation of the second embodiment of the invention shown in FIG. 5, at the beginning of the compression stroke, fluid from the amplifier cylinder 35 is applied to both the compression cylinder 20 and to the auxiliary compression cylinder 197. The pressurization of the compression cylinder 197 forces the cam follower 200 against the stopping slope 195 of the cam 192 at the beginning of the compression stroke. The force against the cam 192 assists the compression cylinder 20 in moving the connecting rod 23 and combustion cylinder piston 18 into the combustion cylinder 15. As the compression stroke continues, the cam follower 200 engages the intermediate slope 194 of the cam, and the force applied by the auxiliary compression cylinder 197 is reduced. Subsequently, the cam follower 200 engages the starting slope 193 of the cam 192 and again provides significant force in moving the combustion cylinder piston 18 as the pressure within the combustion cylinder 15 reaches its maximum value. When the pressure of gases within the combustion cylinder 15 exceed the combined force of the compression cylinder 20 and the auxiliary compression cylinder 197 through the cam 192, the compression stroke ends, and the power stroke begins with the injection of fuel into the combustion cylinder 15.

The acceleration and velocity of the power stroke is controlled by the cam slope, which replaces the mass 26. The profile of the cam 192 is determined by the pressure within the combustion cylinder for the duration of the power stroke. The initial thrust of combustion in the combustion cylinder 15 forces the starting slope 193 of the cam 192 against the cam follower 200, slowing the rapid acceleration of the connecting rod 23 and compression cylinder piston 21, while compressing fluid within the auxiliary compression cylinder 197. As the pressure rises within the compression cylinder 20 and the auxiliary compression cylinder 197 to exceed the pressure in the accumulator 12, additional fluid will be pumped into the accumulator 12 through the high pressure conduit 30. As the cam follower 200 engages the intermediate slope 194, less resistance to the movement of the connecting rod 23 is provided by the cam 192 and auxiliary compression cylinder 197. As the power stroke comes to an end, the cam follower 200 engages the stopping slope 195 of the cam 192. The stopping slope 195 is steeper than the intermediate slope 194, and therefore utilizes the inertia of the cam and other moving parts connected to the connecting rod 23 to force fluid from the auxiliary compression cylinder 197 into the accumulator 12.

Further details of the operation of the second embodiment 190 are similar to those described above in connection with the embodiment shown in FIGS. 1–4, with the exception that operation of the relief valve 54 results in relieving the pressure of fluid in both the compression cylinder 20 and the auxiliary compression cylinder 197.

As a modification of the second embodiment of the invention, not shown in the drawing, it is possible to provide a second cam and auxiliary compression cylinder mounted with respect to the connecting rod 23 directly opposite the cam 192 and the auxiliary compression cylinder 197. Such an arrangement would give the system dynamic balance. Multiple pairs of opposed cams with auxiliary compression cylinders could also be provided.

Figure 7:
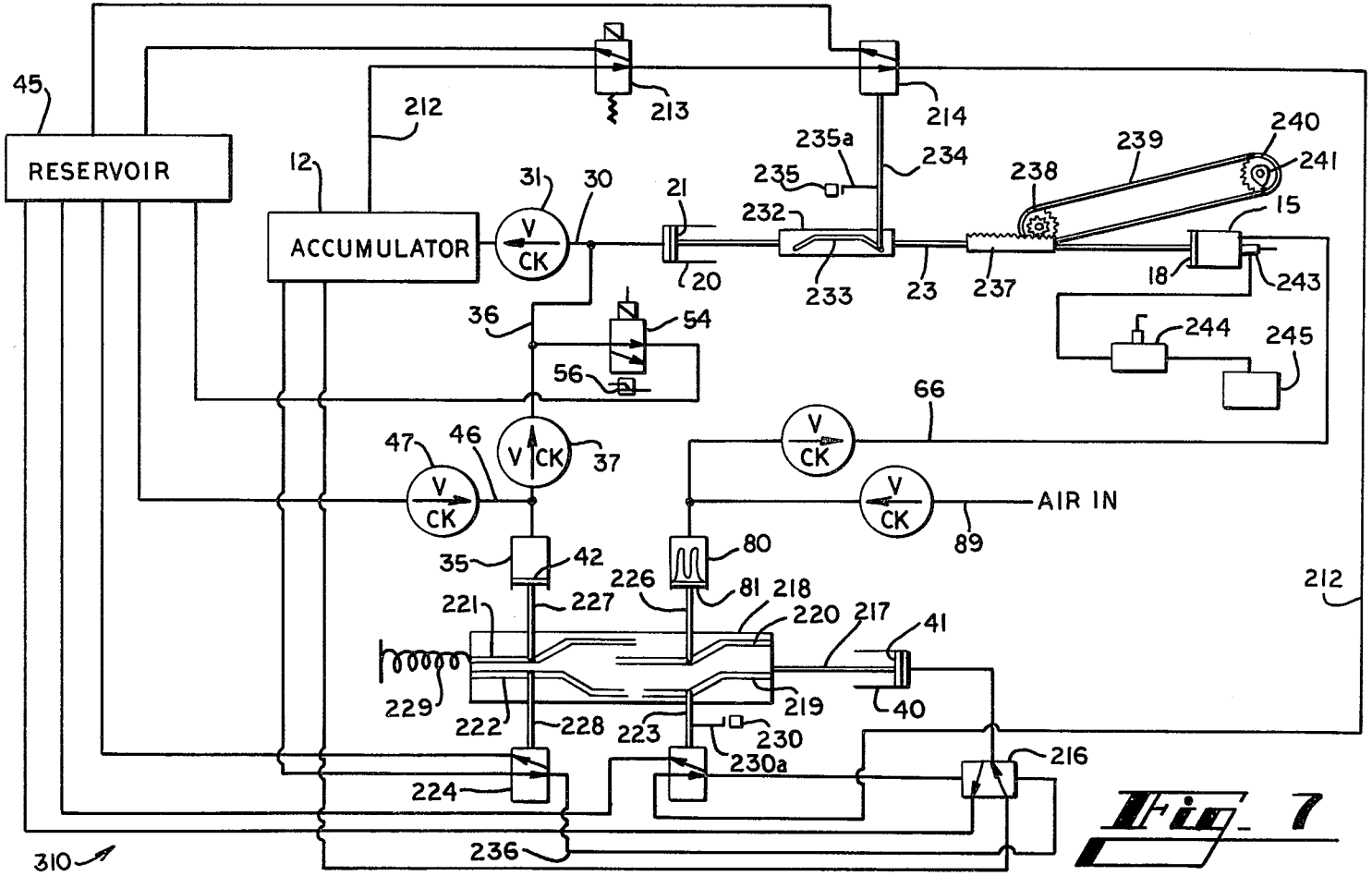
FIG. 7 is a schematic hydraulic circuit diagram showing a third embodiment of an internal combustion driven pumpin system according to the invention.

FIG. 7 shows a third embodiment of an internal combustion driven pumping apparatus 210 according to the present invention. In the embodiment shown in FIG. 7, the accumulator 12 is connected by a liquid conduit 212 to a run valve 213, a compression cylinder ready valve 214, an amplifier cylinder ready valve 215 and a driver cylinder control valve 216. The run valve 213 is an electrically operated solenoid valve which can be alternated from a flow through position which allows fluid flow from the accumulator 12 along conduit 212, to a reservoir position. The compression cylinder ready control valve 214 is mechanically operated, as will be described below, and also can be switched between a flow through position and a reservoir position. The amplifier ready control valve 215 is mechanically operated, and also can be switched between a flow through position and a reservoir position. The driver cylinder control valve 216 is operated by fluid pressure, such that when fluid pressure is applied to the side of the control valve 216 which is connected to the amplifier ready control valve 215, the valve 216 will connect the drive cylinder 40 to the accumulator 12. The control valve 216 will remain in this position until fluid pressure is applied to the opposite side of the valve, at which time the drive cylinder 40 will be connected to the reservoir 45.

The drive cylinder 40 includes its piston 41, which is connected to an operating bar 218 instead of being directly connected to the piston of the fluid amplifier cylinder 35. The piston 41 is connected to the operating bar 218 by a connecting rod 217. A return spring 229 is provided to bias the operating bar toward the drive cylinder 40. The return spring 229 could, of course, be replaced by a hydraulic cylinder with appropriate controls.

The operating bar 218 includes a plurality of cam grooves 219–222 which are provided with selected shapes to operate elements of the system in timed relationship. A connecting rod/cam follower assembly 226 extends from the cam groove 220 to the piston 81 of the air input cylinder 80. A connecting rod/cam follower 227 extends from the cam groove 221 to the piston 42 of the fluid amplifier cylinder 35. A connecting rod/cam follower assembly 228 extends from the cam groove 222 to operate a drive cylinder full stroke control valve 224, which can be operated to a flow through position connecting the accumulator 12 to the drive cylinder control valve 216 along a fluid conduit 236; the full stroke control valve 224 can also connect the control valve 216 to the reservoir 45.

A connecting rod/cam follower assembly 225 extends from the cam groove 219 to the amplifier ready control valve 215. A position detector 230 is optionally mounted adjacent to the connecting rod 225. The detector 230 is activated by a trigger 230*a* to provide a signal to the electronic control circuit when the connecting rod 225 has been operated by the cam groove 219 to place the amplifier ready control valve 215 in a flow through position.

A second operating bar 232 is mounted for travel with the connecting rod 23 between the compression cylinder 20 and the combustion cylinder 15. The operating bar 232 includes a cam groove 233, and a connecting rod/cam follower assembly 234 extends from the cam groove 233 to operate the compression cylinder ready control valve 214. A position detector 235 is mounted adjacent to the connecting rod 234, and is triggered by a trigger 235*a* when the connecting rod 234 operates the compression cylinder ready control valve 214 to a flow through position. A gear rack 237 is also mounted for movement with the connecting rod 23. A timing gear 238 engages the gear rack 237 and is rotated according to the reciprocating movement of the gear rack with the connecting rod 23. A timing chain 239 extends from the timing gear 238 to a sprocket 240 which drives a cam shaft 241. In place of the detailed control mechanism shown in FIG. 2, the fuel, air and exhaust devices associated with the combustion cylinder 15 are provided in conventional fashion by means of valves operated by cams on the cam shaft 241. However, since the injection of water into the combustion cylinder 15 must occur only when the temperature of the combustion cylinder is sufficiently high, a water injector 243 is provided to inject water from a water storage 245 when a water valve 244 is opened in response to control signals provided when the heat sensor 125 senses an appropriate temperature of the combustion cylinder 15.

Operation of the third embodiment shown in FIG. 7 occurs in response to presence of all the inputs required to an AND gate similar to AND 132 of FIG. 3. The required inputs are from master switch 131, accumulator set pressure detector 33, accumulator start pressure detector 32, and relief valve position detection 56. Signals from position detectors 235 and 230 can be made necessary inputs, but the same function is provided physically by the compression cylinder ready control valve 214 and the amplifier ready control valve 215, which prevent a new cycle from going forward if the compression cylinder piston 21 has not fully completed the power stroke or if the operating bar 218 has not returned to its starting position. A signal is directed to the run valve 213, switching it from the reservoir position to the flow through position, allowing pressurized fluid to flow along the conduit 212 from the accumulator 12 through the run valve and through the compression cylinder ready control valve 214, which is in a flow through position when the compression cylinder piston 21 is in its starting position, as determined by the cam 233. The fluid pressure along conduit 212 flows through the amplifier ready control valve 215, which is also in a flow through position, and activates the drive cylinder control valve 216 to switch the valve 216 to connect the drive cylinder 40 to the accumulator 12. The pressurization of the drive cylinder 40 causes the piston 41 to move the operating bar 218 to the left in FIG. 7, against the pressure of the return spring 229. As the operating bar 218 moves, it will first operate the air input cylinder 80 to provide air to the combustion cylinder 15 along the air input pipe 66. At about the same time, the amplifier ready control valve is operated by the cam groove 219 to connect the drive cylinder control valve 216 to the reservoir 45, relieving the pressure which switched the drive cylinder control valve 216.

As the operating bar 218 continues to be moved by the drive cylinder 40, and the air input cylinder 80 completes its stroke, the fluid amplifier cylinder 35 is operated by the cam groove 221. This will force fluid into the compression cylinder 20 in the manner described in connection with earlier embodiments. The pressurized compression cylinder 20 begins to move the connecting rod 23 and operating bar 232 to the right in FIG. 7. The cam groove 233 causes the connecting rod 234 to switch the compression cylinder ready control valve 214 to connect the conduit 212 to reservoir.

When the operating bar 218 reaches the end of the compression stroke, the drive cylinder full stroke control valve 224 is operated to connect the accumulator 12 to the opposite side of the drive cylinder control valve 216, switching the valve 216 to connect the drive cylinder 40 to the reservoir. The force of the return spring 229 then begins to move the operating bar 218 back toward the drive cylinder 40. Initially, the drive cylinder full stroke control valve is switched back to the reservoir position, relieving the pressure from the drive cylinder control valve 216. The piston 42 of the amplifier cylinder 35 is retracted to draw in fluid from the reservoir 45. The piston 81 of the air input cylinder 80 is retracted to draw in fresh air through the pipe 89. As the return movement of the operating bar 218 is completed, the amplifier ready control valve 215 is switched back to a flow through position.

Meanwhile, the power stroke has moved the connecting rod 23 back toward the compression cylinder 20. This results in the cam groove 233 switching the compression cylinder ready control valve back to a flow through position, whereupon the position detector 235 transmits a signal to the control circuitry. The position detector 235 in the embodiment shown in FIG. 7 performs the function of the detector 28 shown in FIG. 1, in that the control circuit activates the relief valve 54 if the end of the power stroke is not sensed by the detector 235 within a predetermined time.

With all of the control valves moved back to the ready position, if the other required inputs are present to the control circuitry, another cycle of the apparatus 210 will occur.

It will be understood that when a conventional valving arrangement utilizing the timing gear 238 and gear rack 237 is provided, it is necessary to operate the apparatus 210 in a constant stroke length mode. Therefore, the apparatus must be operated to provide a constant accumulator pressure, or must be provided with fuel, air and water adjustments as discussed above in order to enable variations in the desired accumulator pressure while maintaining a constant stroke length during the operation of the apparatus.

Figure 8:
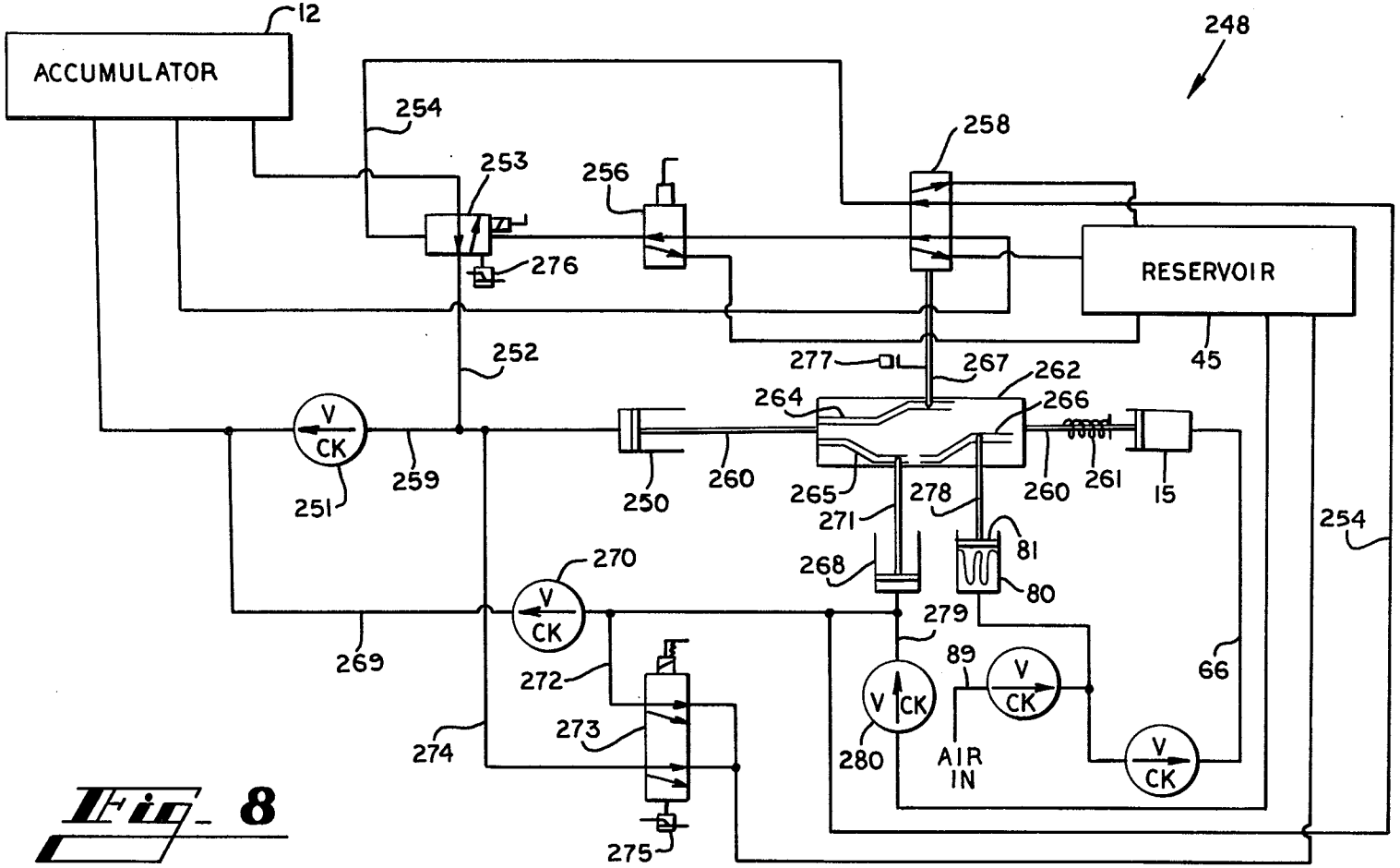
FIG. 8 is a schematic hydraulic circuit diagram showing a fourth embodiment of an internal combustion driven pumping system according to the invention.

A fourth embodiment of the invention is shown in FIG. 8. In the embodiment shown in FIG. 8, the compression stroke of the combustion cylinder is driven directly by a driver cylinder 250, which is connected along a high pressure conduit 252 to the accumulator 12 by way of a driver control valve 253 in the conduit 252. The driver control valve 253 can be hydraulically and electrically operated. Hydraulic pressure along a conduit 254 connected to one side of the valve 253 closes the valve to block the conduit 252. Pressure in a conduit 255 connected to the other side of the valve 253 operates the valve to a flow through position, connecting the accumulator 12 to the conduit 252. The conduit 255 includes a run valve 256 which is an electrically operated solenoid valve that is switched by a signal from control circuitry between a flow through position and a position connecting the driver control valve 253 to the reservoir 45.

A ready control valve 258 is provided, and is responsive to the position of the combustion cylinder piston in the compression or power stroke. The ready control valve 258 is a two-port valve, one port being in the conduit 254, and the other port being in the conduit 255. The valve 258 is constructed so that when the port associated with the conduit 255 is in a flow through position, the port associated with conduit 254 connects the driver control valve 253 to the reservoir. Conversely, when the port associated with conduit 254 is in a flow through position, the port associated with the conduit 255 connects the conduit 255 to the reservoir.

The driver cylinder 250 is also connected to the accumulator by a high pressure line 259. The piston of the driver cylinder 250 is connected to the piston of the combustion cylinder 15 by a connecting rod 260 which is biased toward the driver cylinder 250 by a return spring 261. An operating bar 262 is mounted for movement with the connecting rod 260. The operating bar 262 includes three cam grooves, 264–266. A connecting rod/cam follower assembly 267 extends from the cam groove 264 to operate the ready control valve 258. A fluid amplifier cylinder 268 is provided, and its piston is operated by a connecting rod/cam follower assembly 271 which extends to the cam groove 265. The piston 81 of the air drive cylinder 80 is operated by a connecting rod/cam follower assembly 278 which extends to the cam groove 266. As was the case in previous embodiments, the air cylinder 80 is connected to the combustion cylinder 15 by the air input pipe 66, and sucks in fresh air through the air line 89.

The fluid amplifier cylinder 268 is connected to the reservoir 45 by a conduit 279 which includes a check valve 280 that permits fluid to flow from the reservoir into the amplifier cylinder 268, but not from the cylinder 268 to the reservoir. The amplifier cylinder 268 is also connected to the accumulator 12 via a conduit 269 which includes an amplifier output check valve 270. The conduit 254 connects to the conduit 269 between the fluid amplifier cylinder 268 and the output check valve 270, and extends through the ready control valve 258 to one side of the driver control valve 253, as described above. Also connected to the conduit 269 prior to the check valve 270 is a conduit 272 which leads to a relief valve 273. The relief valve 273 is a two-port electrically operated solenoid valve. One port connects the conduit 272 to the reservoir, and the other port connects the reservoir to a conduit 274 which leads to the driver output conduit 259 between the driver cylinder 250 and a driver output check valve 251. In its open position, both ports of the relief valve 273 are in flow through positions, and in its closed position, both ports of the valve 273 block the conduits 272 and 274.

In operation of the direct drive version of the invention shown in FIG. 8, pressure is provided in the conduit 255 to switch the driver control valve 253 to a flow through position when the control circuit has been provided the necessary inputs to operate the run valve 256 to a flow through position, and when the ready control valve 258 has been switched to a flow through position with respect to conduit 255 by the positioning of the operating bar 262 at the end of the power stroke of the combustion cylinder 15. With the driver control valve 253 in a flow through position, fluid under pressure flows from the accumulator 12 to the driver cylinder 250, and this starts the compression stroke.

As the operating bar 262 moves toward the combustion cylinder 15, the air cylinder 80 will be operated to provide air to the combustion cylinder. Also, shortly after the bar 262 begins to move, the ready control valve 258 is operated to connect the conduit 255 to the reservoir, relieving the hydraulic pressure which previously operated the driver control valve 253. At the same time, the other port of the valve 258 is operated to a flow through position with regard to conduit 254. As the bar 262 continues to move toward the combustion cylinder, the fluid amplifier cylinder 268 is operated to draw fluid into the cylinder from the reservoir 45.

After combustion, at the start of the power stroke, the movement of the operating bar 262 toward the driver cylinder 250 raises the fluid pressure in the fluid amplifier cylinder 268. A small amount of this fluid flows along conduit 254 through the ready control valve 258 to operate the driver control valve 253 to the closed position. The continued movement of the bar 262 forces fluid in the driver cylinder 250 and the fluid amplifier cylinder 268 into the accumulator 12. Air is drawn back into the air cylinder in preparation for the next stroke.

At the end of the power stroke, the operating bar 262 causes the ready control valve 258 to be switched, so that one port is again in the flow through position with respect to conduit 255, and the other port connects conduit 254 to the reservoir. This relieves the hydraulic pressure that closed the driver control valve 253. Since the valves in the conduit 255 are now in the flow through position, the driver control valve will again be operated to connect the accumulator 12 to the driver cylinder 250 unless one of the inputs to the run valve from the control circuitry is absent.

The embodiment shown in FIG. 8 also includes position detector 275, 276 and 277 which provide signals to the control circuitry responsive to the position of the relief valve 273, the driver control valve 253, and the ready control valve 258. The relief valve 273 is connected to relieve pressure both from the driver cylinder circuit and the fluid amplifier cylinder circuit. The relief valve 273 is operated by control circuitry such that it cannot be opened unless a signal is provided by the detector 276 indicating that the driver control valve 253 has been closed. In other respects, the relief valve 273 is operated in response to the time required for the detector 277 to indicate that the power stroke has been completed, in a manner similar to that described for previous embodiments. The air, water, fuel and exhaust functions associated with the combustion cylinder 15 can be provided for the apparatus shown in FIG. 8 in one of the alternate ways described above for previous embodiments.

It should be further understood that the embodiment shown in FIG. 8 could be modified by removing the amplifier cylinder 268, and connecting one side of the port of the ready control valve 258 that is associated with the conduit 254 to the accumulator 12. It is also possible to operate the compression stroke by pressure from an intermediate level pressure source independent of the accumulator 12. Such an intermediate pressure source would be connected to the driver cylinder 250 through the driver control valve 253.

Figure 9:
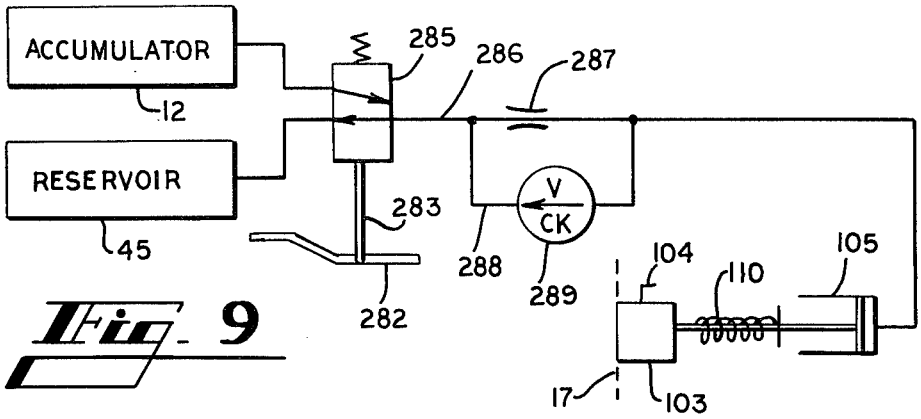
FIG. 9 shows a cam-control fuel injector for use with a system embodying the invention.

FIG. 9 shows an alternative method for operating the fuel injector 103 to inject fuel into the cylinder head 17. In place of the timers of the electronic control circuit 130, a cam groove 282 is provided on an operating bar mounted to move with the combustion cylinder connecting rod, in a manner similar to that shown in FIG. 8. A connecting rod/cam follower 283 operates a control valve 285 to switch the valve 285 between the accumulator 12 and the reservoir 45. As the compression stroke begins, the cam groove moves and switches the valve 285 to connect the fuel drive cylinder 105 to the accumulator 12 through a conduit 286. The conduit 286 also includes a flow restrictor 287 to control the flow of fluid and thereby the fuel injection rate. When the power stroke begins, the cam groove 282 moves in the opposite direction, switching the control valve 285 back to the reservoir 45. At this time the return spring 110 disengages the fuel injector 103 and ejects the fluid from the fuel drive cylinder 105 back to the reservoir by way of a bypass line 288 around the flow restrictor 287. The bypass line 288 includes a check valve 289, and allows rapid resetting of the fuel injector the next stroke. The timing of the fuel injection can be selected by modifying the shape of the cam groove 282. It will be understood by those skilled in the art that a similar arrangement could be used to operate the water injector 114, the intake valve 64 and the exhaust valve 92.

Concepts of the present invention could also be embodied in an apparatus including an opposed piston diesel engine (not shown). In known opposed diesel engines, two pistons operate in the same cylinder. The engine uses two crank shafts which are geared together to insure proper timing between the opposed pistons. Two sets of ports in the cylinder are located at a point near the location at which the pistons reach bottom dead center position. One set of ports is used for air inlet, and the other set used for exhaust. The fuel is injected at the center of the cylinder where the opposed pistons come within close contact to each other. The inlet air expells the exhaust from the previous power stroke. As the pistons come close together, the air is compressed, and at the proper moment fuel is injected into the cylinder to be ignited when it hits the hot compressed air. The increase in pressure drives the cylinders apart.

As applied to the present invention, the opposed piston principal would result in two sets of compression cylinders being driven from a common amplifier cylinder through separate check valves. The output of the two compression cylinders would feed into a common accumulator. Common fuel, water and air systems would feed the combustion chamber between the opposed pistons, operating in the same basic manner as that described above for a single combustion cylinder embodiment. Since the pistons in an opposed piston version of the invention would be essentially free floating with respect to one another, an arrangement of gear racks, one attached to each piston, and a timing gear engaging both racks, would be utilized to insure proper timing between the pistons.

It will be understood that the embodiments of the present invention described above could be operated using conventional spark ignition rather than a compression ignition or diesel engine type of operation. This would require the addition of a conventional carburetor or fuel injection device for delivering fuel and air into the combustion cylinder, and a control system to fire the spark plug at the appropriate time.

Figure 10:
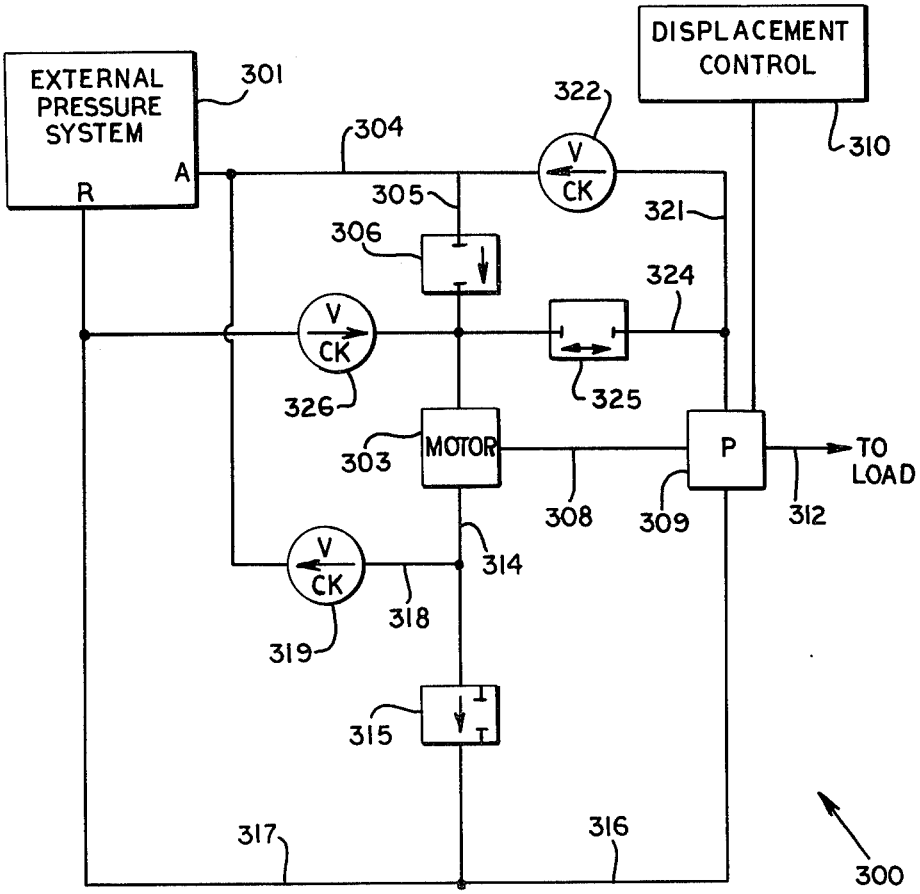
FIG. 10 is a schematic hydraulic circuit diagram showing a transmission system embodying the invention.

FIG. 10 shows a transmission system 300 that can be used with the fluid pumping apparatus 10 or with any other external source of high pressure fluid, represented diagramatically in FIG. 10 as an external pressure system 301. The external pressure system 301 includes an accumulator connection "A" and a reservoir connection "R". The transmission system 300 operates as a feedback torque limiter. A hydraulic motor 303 is connected by high pressure conduits 304 and 305 to the accumulator. Conduit 305 includes a hydraulic cutoff valve 306. The motor 303 is a conventional industrial type fixed displacement hydraulic motor. The cutoff valve 306, and the other cutoff valves to be described below, are conventional industrial-type hydraulic valves, which can be manually, electrically or hydraulically operated.

The motor 303 drives a motor shaft 308 that is mechanically connected to operate a variable displacement hydraulic pump 309, which is also of conventional industrial construction. The pump 309 includes a conventional displacement control 310. The pump 309 drives a pump output shaft 312, which is connected to a rotational load which is to be driven by the energy of the external pressure system 301.

The fluid output of the motor 303 is connected to a low pressure conduit 314 which includes a cutoff valve 315. Following the valve 315, the conduit 314 splits into a conduit 316, which is connected to the input of the hydraulic pump 309, and a conduit 317 which is connected to the reservoir. A conduit 318 is connected to the conduit 314 between the motor 303 and the valve 315, and extends to the accumulator. The conduit 318 includes a check valve 319 which prevents high pressure fluid from the accumulator from flowing into the conduit 314 when the transmission system 300 is being utilized as a motor. The high pressure output of the pump 309 is connected to a fluid conduit 321 which is connected to the accumulator through a check valve 322 which prevents high pressure fluid from the accumulator from traveling back to the pump 309. The conduits 321, 304 and 305 are joined together on the accumulator side of the cutoff valve 306. The output of the pump 309 is also connected to the reservoir by a fluid conduit 324, which is also connected to the conduit 305 between the valve 306 and the motor 303. The conduit 324 includes a cutoff valve 325 between the pump 309 and the conduit 305, and also includes a check valve 326 between the conduit 305 and the reservoir, the check valve 326 preventing fluid from flowing in conduit 324 to the reservoir from the motor 303 or the pump 309.

The transmission system 300 can be operated as a motor or as a brake. When it is being used as a motor, high pressure fluid from the accumulator of the external pressure system 301 is allowed to flow to the motor 303 with the cutoff valve 306 opened and the cutoff valve 325 closed. The fluid will flow through the conduits 304 and 305, through the fixed displacement motor 303, through the cutoff valve 315 in the open position, and to the low pressure return line 317. This will cause the motor 303 to produce a constant rotating torque.

The torque available to operate the load is controlled by adjusting the displacement control 310 of the variable displacement pump 309. When the pump is set to provide fluid output, low pressure fluid is drawn into the pump along the conduit 316 and pumped at higher pressure into the conduit 321. Such fluid will be fed back to the motor 303 through the conduit 305, or will be pumped into the accumulator 304, depending upon pressure conditions. Thus, the torque produced by the motor 303 that is not required to rotate the load is not wasted, but is used to operate the motor 303 or is stored. Furthermore, the motor 303 is continuously operated at its most efficient torque despite changes in the amount of torque applied to the load.

If it is desired that the motor 303 provide minimum torque to the load, the pump 309 is controlled to operate at maximum displacement. This will cause the pump to move a maximum amount of fluid from the low pressure line 316 through the check valve 322 into the high pressure conduits 304 and 305. In order to provide maximum torque to the load, the pump 309 is controlled to the neutral position. The pump will then cease pumping fluid and the torque to the load is the maximum that the motor 303 will produce, since very little energy is dissipated by the pump when it is idling. It will thus be seen that the motor torque provided to move the load can be infinitely controlled by controlling the variable volume pump 309 between minimum and maximum displacement.

If more torque is required than can be supplied by the motor 303 above, the pump 309 can be operated as a supplemental motor by opening cut off valves 306, 315 and 325, thereby allowing high pressure fluid to flow from conduit 305 to the motor 303 and along conduits 324 and 321 to the pump 309. Low pressure return from both the pump and the motor is along line 317 to the reservoir. The displacement control 310 can be used to determine how much torque is applied to the load by the pump when operating as a motor.

To operate the transmission system 300 as a dynamic brake, the cutoff valve 306 is closed, which prevents high pressure fluid from flowing to the motor 303. To prevent cavitation in the motor 303, fluid from the reservoir is allowed to flow through the conduit 324 and the check valve 326, through the motor 303 and the open cutoff valve 315, and back to the reservoir through the conduit 317. When the valves have been thus operated, the momentum of the load will be driving the pump 309 and the mechanically connected motor 303. To bring the load to a stop the pump 309 is controlled to operate at the displacement required to give the desired deceleration rate. This will cause the pump to move fluid from the low pressure conduit 316 through the check valve 322 into the high pressure line 304. The torque required to operate the pump 309 will act against the momentum of the load and bring it to a stop. Thus, the pump torque provided to decelerate the load can be infinitely controlled by controlling the displacement of the pump 309.

If greater deceleration is desired, the motor 303 can be controlled to assist the pump 309 in the braking effort. To accomplish this, the cutoff valve 325 is opened while the cutoff valve 315 is simultaneously closed. The pump 309 is placed in the neutral position, and while this is happening to fluid flow through the pump 309 is allowed to flow to the motor 303 through the conduit 324. Since the pressure across the pump 309 is equalized, the torque developed by the pump drops to zero, while at the same instant the output of the motor 303 is prevented from returning to the low pressure return line by the closing of the valve 315. Therefore, the fluid output from the motor 303 is directed through the check valve 319 in the conduit 318 into the high pressure line 304. This causes the torque in the motor 303 to increase to the maximum value. Subsequent closing of the valve 325 and operation of the pump 309 at a selected displacement rate further increases the deceleration of the load. Thus, the deceleration rate can be controlled up to the point where the motor 303 and the pump 309 are moving the maximum amount of fluid from the low pressure conduits to the high pressure conduits.

To reduce the braking rate to a level that can be provided by the pump 309 alone, the valve 315 is opened. This allows the output fluid from the motor 303 to return to the low pressure conduit 317, reducing the motor torque to zero. The pump 309 can then be controlled to operate at the displacement required to give the desired lower deceleration rate.

The transmission system 300 can be modified so that the motor 303, pump 309 and load are mechanically drivingly connected by means other than the direct shaft connection shown in FIG. 10. The connections can be by way of gears, or the motor and pump can be independently connected to the load, and therefore connected to each other through the load.

It will thus be seen that the transmission system 300 eliminates energy losses experienced in prior variable torque systems by utilizing a variable volume feedback pump which pumps fluid from the motor low pressure outlet to the high pressure inlet side of the motor and thereby controls the torque available to the load. During braking, energy is conserved by using the energy of the rotating load to operate the pump to drive fluid into an accumulator, and thereby store the energy for use to operate the transmission system when the next motoring cycle begins.

While this invention has been described in detail with particular reference to preferred embodiments thereof, it will be understood that variations and modifications can be effected within the spirit and scope of the invention as described hereinbefore and as defined in the appended claims.

I claim:

1. In an internal combustion driven fluid pumping apparatus for accumulating fluid pressure to be applied against a load, including a two-stroke combustion cylinder having a first reciprocable piston therein, a compression cylinder having a second reciprocable piston therein drivingly connected to said first piston, and accumulator means for storing fluid pressure pumped into said accumulator means by the energy of combustion occurring in said combustion cylinder, the improvement comprising:

means for operating said combustion cylinder only in response to the pressure in said accumulator means falling below a predetermined level;

means for operating said first and second pistons at the same substantially constant speed within the combustion and compression cylinders, respectively, during each stroke; and means for regulating said speed of said second piston to regulate the rate of fluid flow from said compression cylinder into said accumulator means.

2. In a method of pumping fluid into an accumulator including the steps of compressing and burning fuel and air in an internal combustion cylinder, having a first piston, to drive a compression cylinder, having a second piston, during a power stroke, to pump fluid into said accumulator, the improvement comprising the steps of:

operating said combustion cylinder only in response to the pressure in said accumulator falling below a predetermined level by transmitting fluid under pressure from said accumulator to said compression cylinder at a pressure less than the pressure in said accumulator to compress fuel and air in said combustion cylinder; and operating said first and second pistons at the same substantially constant speed within the combustion and compression cylinders, respectively, during each stroke.

3. The method of claim 2, further comprising the step of relieving fluid pressure in said compression cylinder responsive to said power stroke not being completed within a predetermined period of time.

4. The method of claim 2, further comprising the step of regulating the speed of movement of said second piston to regulate the rate of fluid flow from said compression cylinder into said accumulator.

5. An internal combustion engine and fluid pump comprising:

a combustion cylinder including a first reciprocable piston therein;

means for admitting combustible gases into said combustion cylinder;

a compression cylinder including a second reciprocable piston therein drivingly linked to said first piston;

accumulator means containing said fluid and connected by a fluid path to said compression cylinder;

means for sensing the pressure of fluid in said accumulator means;

control means responsive to the pressure of fluid in said accumulator means falling below a predetermined level for forcing fluid into said compression cylinder to move said second piston from a starting position and thereby to move said first piston within said combustion cylinder to compress combustion gases in said combustion cylinder; said control means comprising a drive cylinder including a third reciprocable piston therein; drive valve means for selectively admitting pressurized fluid into said drive cylinder; an amplifier cylinder having a cross-sectional area greater than said drive cylinder and including a fourth reciprocable piston therein drivingly linked to said third piston; amplifier input valve means for filling said amplifier cylinder from a reservoir and emptying said drive cylinder when said drive cylinder is not connected to pressurized fluid; amplifier output valve means for connecting said amplifier cylinder to said fluid path when said drive cylinder is connected to said pressurized fluid; and check valve means in said fluid path between said accumulator means and said compression cylinder for preventing escape from said accumulator means of fluid forced into said accumulator means by said second piston upon combustion within said combustion cylinder.

6. An internal combustion engine and fluid pump comprising:

a combustion cylinder including a first reciprocable piston therein;

means for admitting combustible gases into said combustion cylinder;

a compression cylinder including a second reciprocable piston therein drivingly linked to said first piston;

accumlator means containing said fluid and connected by a fluid path to said compression cylinder;

means for sensing the pressure of fluid in said accumulator means;

control means responsive to the pressure of fluid in said accumulator means falling below a predetermined level for forcing fluid into said compression cylinder to move said second piston from a starting position and thereby to move said first piston within said combustion cylinder to compress combustible gases in said combustion cylinder;

check valve means in said fluid path between said accumulator means and said compression cylinder for preventing escape from said accumulator means of fluid forced into said accumulator means by said second piston upon combustion within said combustion cylinder;

means biasing said first and second pistons toward said starting position;

means for sensing return of said first and second pistons to said starting position following combustion in said combustion cylinder; and means responsive to said first and second piston being absent from said starting position for longer than a predetermined period of time, for relieving the pressure of said fluid in said compression cylinder.

7. An internal combustion engine and fluid pump comprising:

a combustion cylinder including a first reciprocable piston therein;

means for admitting combustible gases into said combustion cylinder;

a compression cylinder including a second recirpocable piston therein drivingly linked to said first piston;

accumulator means containing said fluid and connected by a fluid path to said compression cylinder;

means for sensing the pressure of fluid in said accumulator means;

control means responsive to the pressure of fluid in said accumulator means falling below a predetermine level for forcing fluid into said compression cylinder to move said second piston from a starting position and thereby to move said first piston within said combustion cylinder to compress combustible gases in said combustion cylinder;

check valve means in said fluid path between said accumulator means and said compression cylinder for preventing escape from said accumulator means of fluid forced into said accumulator means by said second piston upon combustion within said combustion cylinder;

position detection means for providing a ready signal when said first and second pistons are in said starting position, said control means being responsive to said pressure of fluid in said accumulator and to presence of said ready signal; and stroke adjusting means for varying the location along the path of travel of said first and secod pistons at which said ready signal is provided.

8. The apparatus of claim 7, wherein said stroke adjusting means varies the location at which said ready signal is received responsive to the pressure of fluid in said accumulator means.

9. An internal combustion engine and fluid pump comprising:

a combustion cylinder including a first reciprocable piston therein;

means for admitting combustible gases into said combustion cylinder;

a compression cylinder including a second reciprocable piston therein drivingly linked to said first piston;

accumulator means containing said fluid and connected by a fluid path to said compression cylinder;

means for sensing the pressure of fluid in said accumulator means;

control means responsive to the pressure of fluid in said accumulator means falling below a predetermined level for forcing fluid into said compression cylinder to move said second piston from a starting position and thereby to move said first piston within said combustion cylinder to compress combustible gases in said combustion cylinder; and check valve means in said fluid path between said accumulator means and said compression cylinder for preventing escape from said accumulator means of fluid forced into said accumulator means by said second piston upon combustion within said combustion cylinder;

said combustion cylinder comprising:

cylinder valve means for selectively providing fluid communicating between the interior and exterior of said combustion cylinder;

means for biasing said cylinder valve means into a first position;

a valve operating cylinder including a reciprocable piston therein drivingly connected to said cylinder valve means; and valve control means for selectively connecting said accumulator means to said valve operating cylinder to admit pressurized fluid into said operating cylinder to move said cylinder valve means into a second position, and for alternately disconnecting said accumulator means from said cylinder valve means to allow said biasing means to return said cylinder valve means to its first position.

10. An internal combustion engine and fluid pump comprising:

a combustion cylinder including a first reciprocable piston therein;

means for admitting combustible gases into said combustion cylinder;

a compression cylinder including a second reciprocable piston therein drivingly linked to said first piston;

accumulator means containing said fluid and connected by a fluid path to said compression cylinder;

means for sensing the pressure of fluid in said accumulator means;

control means responsive to the pressure of fluid in said accumulator means falling below a predetermined level for forcing fluid into said compression cylinder to move said second piston from a starting position and thereby to move said first piston within said combustion cylinder to compress combustible gases in said combustion cylinder;

check valve means in said fluid path between said accumulator means and said compression cylinder for preventing escape from said accumulator means of fluid forced into said accumulator means by said second piston upon combustion within said combustion cylinder; and means for limiting the flow rate of fluid being forced into said accumulator means by said second piston by transforming a portion of the energy of combustion in said combustion cylinder into kinetic energy of a mass mounted to move with said first and second pistons.

11. An internal combustion engine and fluid pump comprising:

a combustion cylinder including a first reciprocable piston therein;

means for admitting combustible gases into said combustion cylinder;

a compression cylinder including a second reciprocable piston therein drivingly linked to said first piston;

accumulator means containing said fluid and connected by a fluid path to said compression cylinder;

means for sensing the pressure of fluid in said accumulator means;

control means responsive to the pressure of fluid in said accumulator means falling below a predetermined level for forcing fluid into said compression cylinder to move said second piston from a starting position and thereby to move said first piston within said combustion cylinder to compress combustible gases in said combustion cylinder;

check valve means in said fluid path between said accumulator means and said compression cylinder for preventing escape from said accumulator means of fluid forced into said accumulator means by said second piston upon combustion within said combustion cylinder; and an auxiliary compression cylinder including a reciprocable piston therein drivingly connected to a cam follower;

a cam surface mounted for movement with said first and second pistons and engaging said cam follower; and fluid conduit means connecting said auxiliary compression cylinder to said accumulator means;

said cam surface being operative to drive said auxiliary compression cylinder to force fluid into said accumulator means upon combustion within said combustion cylinder.

12. An internal combustion engine and fluid pump comprising:

a combustion cylinder including a first reciprocable piston therein;

means for admitting combustible gases into said combustion cylinder;

a compression cylinder including a second reciprocable piston therein drivingly linked to said first piston;

accumulator means containing said fluid and connected by a fluid path to said compression cylinder;

means for sensing the pressure of fluid in said accumulator means;

control means responsive to the pressure of fluid in said accumulator means falling below a predetermined level for forcing fluid into said compression cylinder to move said second piston from a starting position and thereby to move said first piston within said combustion cylinder to compress combustible gases in said combustion cylinder;

check valve means in said fluid path between said accumulator means and said compression cylinder for preventing escape from said accumulator means of fluid forced into said accumulator means by said second piston upon combustion within said combustion cylinder; and means for connecting said accumulator means to said load, comprising:

a variable column hydraulic pump including a pump shaft drivingly connected to said load;

a hydraulic motor including a motor shaft drivingly connected to said pump shaft;

a first fluid conduit connecting said accumulator means to a high pressure inlet of said motor;

a second fluid conduit connecting a low pressure outlet of said motor to a low pressure inlet of said pump; and means for varying the output of said pump while maintaining the torque of said motor at a substantially constant rate, whereby the torque transmitted to the load through said pump shaft is controlled by controlling the output of said pump.

13. An internal combustion engine and fluid pump comprising:

a combustion cylinder including a first reciprocable piston therein;

means for admitting combustible gases into said combustion cylinder;

a compression cylinder including a second reciprocable piston therein drivingly linked to said first piston;

accumulator means containing said fluid and connected by a fluid path to said compression cylinder;

means for sensing the pressure of fluid in said accumulator means;

control means responsive to the pressure of fluid in said accumulator means falling below a predetermined level utilizing fluid pressure from said accumulator means for to force fluid into said compression cylinder to move said second piston from a starting position and thereby to move said first piston within said combustion cylinder to compress combustible gases in said combustion cylinder; and check valve means in said fluid path between said accumulator means and said compression cylinder for preventing escape from said accumulator means of fluid forced into said accumulator means by said second piston upon combustion within said combustion cylinder.

14. The apparatus of claim 13, wherein said control means forces fluid into said compression cylinder by forcing fluid into said fluid path between said check valve means and said compression cylinder at a pressure less than the pressure of fluid in said accumulator means and sufficient to compress and ignite combustible gases in said combustion cylinder.

15. The apparatus of claim 13, wherein said control means comprises a drive cylinder including a third reciprocable piston therein;

drive valve means for selectively connecting said accumulator means to said drive cylinder to admit pressurized fluid into said drive cylinder;

an amplifier cylinder having a cross-sectional area greater than said drive cylinder and including a fourth reciprocable piston therein drivingly linked to said third piston;

amplifier input valve means for filling said amplifier cylinder from a reservoir and emptying said drive cylinder when said drive cylinder is not connected to said accumulator means; and amplifier output valve means for connecting said amplifier cylinder to said fluid path when said drive cylinder is connected to said accumulator means.

16. The apparatus of claim 13, further comprising a mass mounted for travel with said first and second pistons, said mass being sufficient to smooth the motion of said pistons responsive to combustion in said combustion cylinder.

17. The apparatus of claim 13, further comprising starting means, responsive to the pressure of fluid in said accumulator means being less than the operating pressure required to ignite combustible gases in said combustion cylinder, for pumping fluid from a reservoir into said accumulator means until the pressure therein reaches said operating pressure.

18. The apparatus of claim 13, wherein said first and second pistons are drivingly connected by a rigid, linear connecting rod.

19. The apparatus of claim 13, further comprising means for limiting the flow rate of fluid being forced into said accumulator means by said second piston by transforming a portion of the energy of combustion in said combustion cylinder into kinetic energy of a mass mounted to move with said first and second pistons.

20. The apparatus of claim 13, wherein said combustion cylinder comprises:

combustion valve means for selectively providing fluid communication between the interior and exterior of said combustion cylinder;

means for biasing said combustion valve means into a closed position;

a combustion valve operating cylinder including a reciprocable piston therein drivingly connected to said combustion valve means; and combustion control valve means for selectively connecting said accumulator means to said combustion valve operating cylinder to admit pressurized fluid into said operating cylinder to open said combustion valve means, and for alternately disconnecting said accumulator means from said combustion valve means to allow said biasing means to close said combustion valve means.

21. The apparatus of claim 13 further comprising means biasing said first and second pistons toward said starting position;

means for sensing return of said first and second pistons to said starting position following combustion in said combustion cylinder; and means responsive to said first and second piston being absent from said starting position for longer than a predetermined period of time, for relieving the pressure of said fluid in said compression cylinder.

22. The apparatus of claim 21, wherein said means for relieving the pressure of said fluid in said compression cylinder comprises selectively operable valve means for connecting said compression cylinder to a reservoir.

23. The apparatus of claim 13, wherein said combustion cylinder comprises:

an outwardly opening intake valve;

spring means urging said intake valve toward its open position;

an intake valve operating cylinder including a fifth reciprocable piston therein drivingly connected to said intake valve; and intake control valve means for selectively connecting said accumulator means to said intake valve operating cylinder to admit pressurized fluid into said input valve operating cylinder and to thereby hold said intake valve in a closed position against said spring means, and alternatively disconnecting said accumulator means from said intake valve operating cylinder to allow said spring means to open said intake valve.

24. The apparatus of claim 23 wherein said combustion cylinder further comprises;

an air drive cylinder including a sixth reciprocable piston therein;

air drive valve means for selectively connecting said accumulator means to said air drive cylinder to admit pressurized fluid into said air drive cylinder;

an air delivery cylinder including a seventh reciprocable piston therein drivingly connected to said sixth piston;

air conduit means including said intake valve, connecting said air delivery cylinder to said combustion cylinder;

said air drive valve means being operative to pressurize said air drive cylinder so as to cause said seventh piston to eject air from said air delivery cylinder through said air conduit means into said combustion cylinder when said intake valve is open.

25. The apparatus of claim 13, further comprising means for injecting water into said combustion cylinder responsive to the temperature of said combustion cylinder being greater than a predetermined level.

26. The apparatus of claim 25, further comprising a layer of insulation surrounding said combustion cylinder.

27. The apparatus of claim 13, further comprising:

an auxiliary compression cylinder including a reciprocable piston therein drivingly connected to a cam follower;

a cam surface mounted for movement with said first and second pistons and engaging said cam follower; and fluid conduit means connecting said auxiliary compression cylinder to said accumulator means;

said cam surface being operative to drive said auxiliary compression cylinder to force fluid into said accumulator means upon combustion within said combustion cylinder.

28. The apparatus of claim 27, wherein said cam surface slopes away from the path of travel of said first and second pistons as said cam surface extends from said compression cylinder toward said combustion cylinder, and is profiled to match the pressure of gases in said combustion cylinder during combustion therein.

29. The apparatus of claim 28, wherein said cam surface includes an initial steeply sloping segment, an intermediate gently sloping segment, and a final steeply sloping segment.

30. The apparatus of claim 13, further comprising means for connecting said accumulator means to a load, comprising:

a variable volume hydraulic pump including a pump shaft drivingly connected to said load;

a hydraulic motor including a motor shaft drivingly connected to said pump shaft;

a first fluid conduit connecting said accumulator means to a high pressure inlet of said motor;

a second fluid conduit connecting a low pressure outlet of said motor to a low pressure inlet of said pump; and means for varying the output of said pump while maintaining the torque of said motor at a substantially constant rate, whereby the torque transmitted to the load through said pump shaft is controlled by controlling the output of said pump.

31. The apparatus of claim 30, further comprising a third fluid conduit connecting a high pressure outlet of said pump to said first fluid conduit, said third fluid conduit including check valve means for preventing flow from said first fluid conduit to said pump.

32. The apparatus of claim 13, further comprising:

position detection means for providing a ready signal when said first and second pistons are in said starting position, said control means being responsive to said pressure of fluid in said accumulator and to presence of said ready signal; and stroke adjusting means for varying the location along the path of travel of said first and second pistons at which said ready signal is provided.

33. The apparatus of claim 32, wherein said stroke adjusting means varies the location at which said ready signal is received responsive to the pressure of fluid in said accumulator means.

34. The apparatus of claim 33, wherein said stroke adjusting means shortens the distance travelled by said first and second pistons responsive to an increase in the presence of fluid in said accumulator means, and lengthens the distance travelled by said first and second pistons responsive to a decrease in the pressure of fluid in said accumulator means.

35. The apparatus of claim 33, wherein said stroke adjusting means varies the location at which said ready signal is provided by varying the location of said position detection means along the path of travel of said first and second pistons.

* * * * *